US009265994B2

(12) United States Patent
Mizutani

(10) Patent No.: US 9,265,994 B2
(45) Date of Patent: Feb. 23, 2016

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 52 days.

(21) Appl. No.: 14/291,394

(22) Filed: May 30, 2014

(65) Prior Publication Data

US 2014/0357402 A1 Dec. 4, 2014

(30) Foreign Application Priority Data

May 31, 2013 (JP) ..... 2013-114899

(51) Int. Cl.
*A63B 53/04* (2015.01)
*A63B 53/06* (2015.01)

(52) U.S. Cl.
CPC ..... *A63B 53/0466* (2013.01); *A63B 2053/0408* (2013.01); *A63B 2053/0491* (2013.01)

(58) Field of Classification Search
CPC ..... A63B 53/0466; A63B 2053/0408; A63B 2053/0491
USPC ..... 473/324–350, 287–292
See application file for complete search history.

(56) References Cited

U.S. PATENT DOCUMENTS

| | | | | |
|---|---|---|---|---|
| 7,628,711 | B2 * | 12/2009 | Akinori | A63B 53/0466 411/337 |
| 8,944,934 | B2 * | 2/2015 | Yamamoto | A63B 53/0466 473/334 |
| 2009/0131200 | A1 | 5/2009 | Akinori et al. | |
| 2012/0172142 | A1 | 7/2012 | Yashiki | |
| 2013/0150180 | A1 * | 6/2013 | Yamamoto | A63B 53/0466 473/339 |
| 2014/0024475 | A1 * | 1/2014 | Motokawa | A63B 53/06 473/338 |
| 2014/0187347 | A1 * | 7/2014 | Yamamoto | A63B 53/047 473/335 |
| 2014/0349779 | A1 * | 11/2014 | Mizutani | A63B 53/06 473/335 |

* cited by examiner

*Primary Examiner* — Sebastiano Passaniti
(74) *Attorney, Agent, or Firm* — Birch, Stewart, Kolasch & Birch, LLP

(57) ABSTRACT

A head 4 includes a socket 10 and a weight body 12. The socket 10 has an upper hole part 18 and a lower hole part 20. The weight body 12 has an engaging part 32. The lower hole part 20 and the engaging part 32 can be relatively rotated. By the relative rotation, the weight body 12 can take an engaging position EP and non-engaging position NP. The engaging part 32 has an outermost part E1. The lower hole part 20 has a first portion 20*x* and a second portion 20*y*. The outermost part E1 can pass through the first portion 20*x* while compressively deforming the first portion 20*x*. A distance D2 between the second portion 20*y* and an axis line Z is greater than a distance D1 between the first portion 20*x* and the axis line Z.

10 Claims, 29 Drawing Sheets

GOLF CLUB HEAD

The present application claims priority on Patent Application No. 2013-114899 filed in JAPAN on May 31, 2013, the entire contents of which are hereby incorporated by reference.

BACKGROUND OF THE INVENTION

1. Field of the Invention

The present invention relates to a golf club head including a weight body.

2. Description of the Related Art

A head capable of replacing a weight body has been known. The position of the center of gravity of the head and the weight of the head can be adjusted by changing the weight of the weight body.

As a mechanism for attaching the weight body, a screw mechanism is typical. Meanwhile, Japanese Utility Model Application Publication No. 3142270 (US2009/0131200) discloses a mechanism including a sleeve and a weight. The sleeve is formed of a material having flexibility. Japanese Patent Application Laid-Open No. 2012-139403 (US2012/0172142) discloses a head cavity body attached to a head and a head weight detachably attached to the head cavity body. The material of the head cavity body is a polymer. In these gazettes, the weight can be attached by a rotation of a predetermined angle, and the weight can be detached by a reverse rotation of a predetermined angle.

SUMMARY OF THE INVENTION

It is preferable that the weight body can be easily attached and easily detached. In respect of convenience, attaching and detaching work is preferably easy.

Secured state of the weight body needs to be maintained during play. In hitting a ball, a strong impact force is applied to the head from the ball. Furthermore, the head can collide against the ground in impact. Falling off of the weight body is likely to occur. In respect of reliability, it is more preferable that the weight body is more certainly secured.

It has been desired to achieve both easiness of the attachment/detachment and the reliability. However, it is difficult to achieve both.

It is an object of the present invention to provide a golf club head which has a weight body easily attached and detached, and is excellent in reliability.

A head according to a preferable first aspect includes a head body, a socket and a weight body. The head body includes a socket housing part. The socket is attached to the socket housing part. The socket includes an upper hole part and a lower hole part. A sectional shape of the upper hole part is different from a sectional shape of the lower hole part. The weight body includes an engaging part. The engaging part includes an outermost part which is farthest from a rotation axis line of the weight body. The engaging part is disposed inside the lower hole part. Relative rotation of the lower hole part and the engaging part can be performed. By the relative rotation, the weight body can take an engaging position and a non-engaging position. The lower hole part includes a first portion and a second portion. The first portion and the second portion are provided on a passing region of the outermost part. In a process of the relative rotation, the outermost part is passing through the first portion while compressively deforming the first portion. When a distance between the first portion and the rotation axis line is defined as D1, and a distance between the second portion and the rotation axis line is defined as D2, the distance D2 is greater than the distance D1 in the same circumferential position.

Ahead of a preferable second aspect includes a head body, a socket and a weight body. The head body includes a socket housing part. The socket is attached to the socket housing part. The socket includes an upper hole part and a lower hole part. A sectional shape of the upper hole part is different from a sectional shape of the lower hole part. The weight body includes an engaging part. The engaging part includes an outermost part which is farthest from a rotation axis line of the weight body. The engaging part is disposed inside the lower hole part. Relative rotation of the lower hole part and the engaging part can be performed. By the relative rotation, the weight body can take an engaging position and a non-engaging position. The lower hole part includes a first portion and a second portion. The first portion includes a compressive deformation part which can be compressively deformed by the outermost part in a process of the relative rotation. The second portion is provided on an upper side or a lower side of the compressive deformation part. A distance between the first portion and the rotation axis line is defined as D1, and a distance between the second portion and the rotation axis line is defined as D2, the distance D2 is greater than the distance D1 in the same circumferential position.

Preferably, the second portion includes a non-contact surface which does not contact with the outermost part in the process of the relative rotation.

Preferably, the second portion is position on a lower side of the first portion.

Preferably, the weight body includes a first rotation regulating part. Preferably, the socket includes a second rotation regulating part. Preferably, by an engagement of the first rotation regulating part and the second rotation regulating part, incorrect rotations other than the relative rotation are regulated.

When an axial-directional length of the first portion is defined as S1, and an axial-directional length of the outermost part is defined as S2, S1/S2 is preferably equal to or greater than 0.3 and equal to or less than 0.9.

BRIEF DESCRIPTION OF THE DRAWINGS

Unlike FIG. 17, FIG. 19 is a cross-sectional view at a position in which a second portion exists;

FIG. 19 also shows the non-engaging position NP and the engaging position EP;

DESCRIPTION OF THE PREFERRED EMBODIMENTS

The present invention will be described below in detail based on preferred embodiments with appropriate reference to the drawings. In the present application, an outside of a head is also referred to as an upper side, and an inside of a head is also referred to as a lower side.

A golf club head of the present embodiment includes a weight body attaching/detaching mechanism. The mechanism satisfies the Golf Rules defined by R&A (Royal and Ancient Golf Club of Saint Andrews). That is, the weight body attaching/detaching mechanism satisfies requirements specified in "1b Adjustability" in "1 Clubs" of "Appendix II Design of Clubs" defined by R&A. The requirements defined by the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
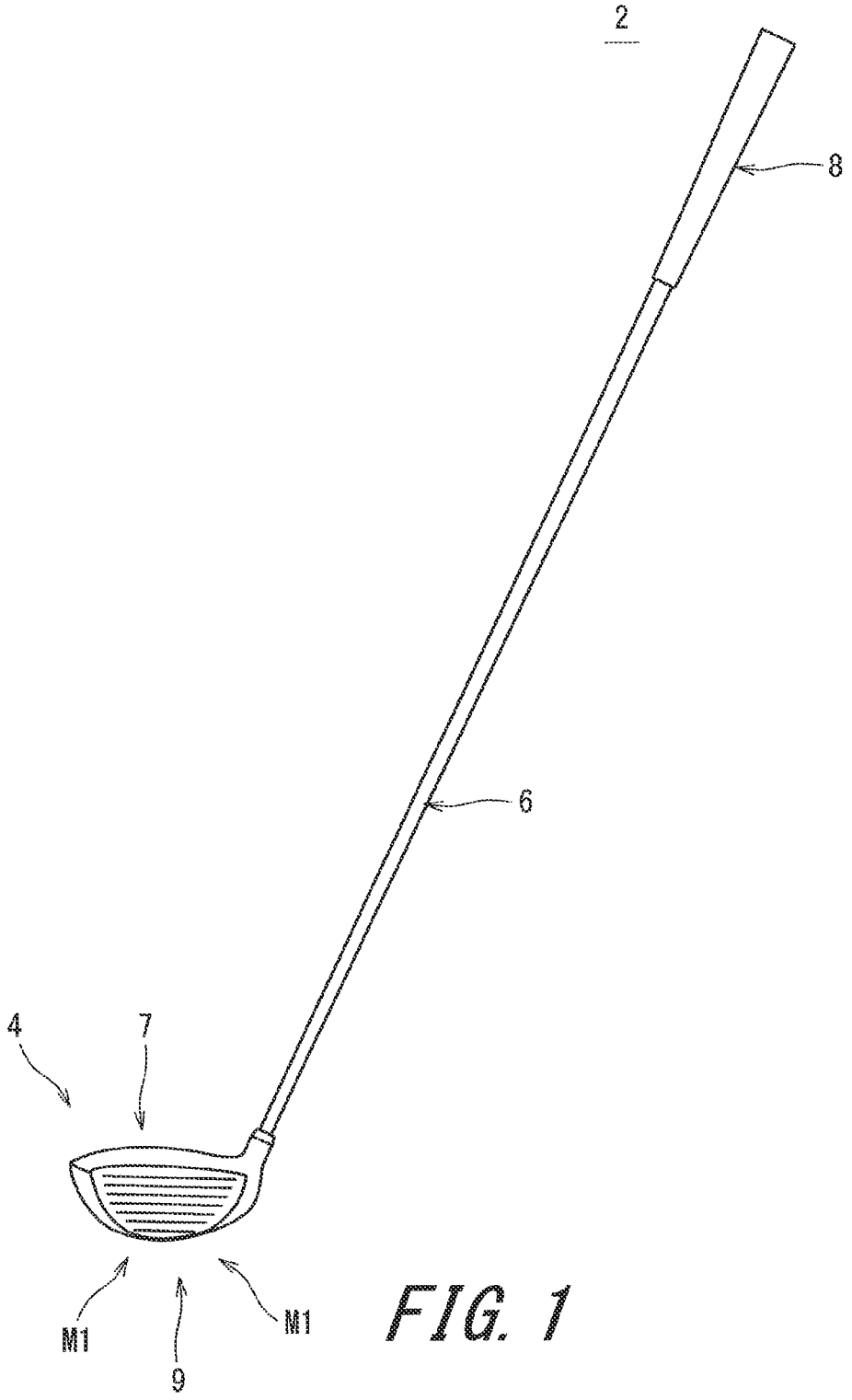
FIG. 1 is an overall view of a golf club including a head according to a first embodiment of the present invention.

FIG. 1 shows a golf club 2 including a head 4 of a first embodiment. The golf club 2 includes the head 4, a shaft 6, and a grip 8. The head 4 is attached to one end part of the shaft 6. The grip 8 is attached to the other end part of the shaft 6. The head 4 includes a crown 7 and a sole 9. The head 4 is hollow.

The head 4 is a wood type head. The real loft angle of the wood type head is usually 8 degrees or greater and 34 degrees or less. The head volume of the wood type head is usually 120 cc or greater and 470 cc or less.

The head 4 is exemplary. Examples thereof include a wood type head, a utility type head, a hybrid type head, an iron type head, and a putter type head. The shaft 6 is a tubular body. Examples of the shaft 6 include a steel shaft and a so-called carbon shaft.

Figure 2:
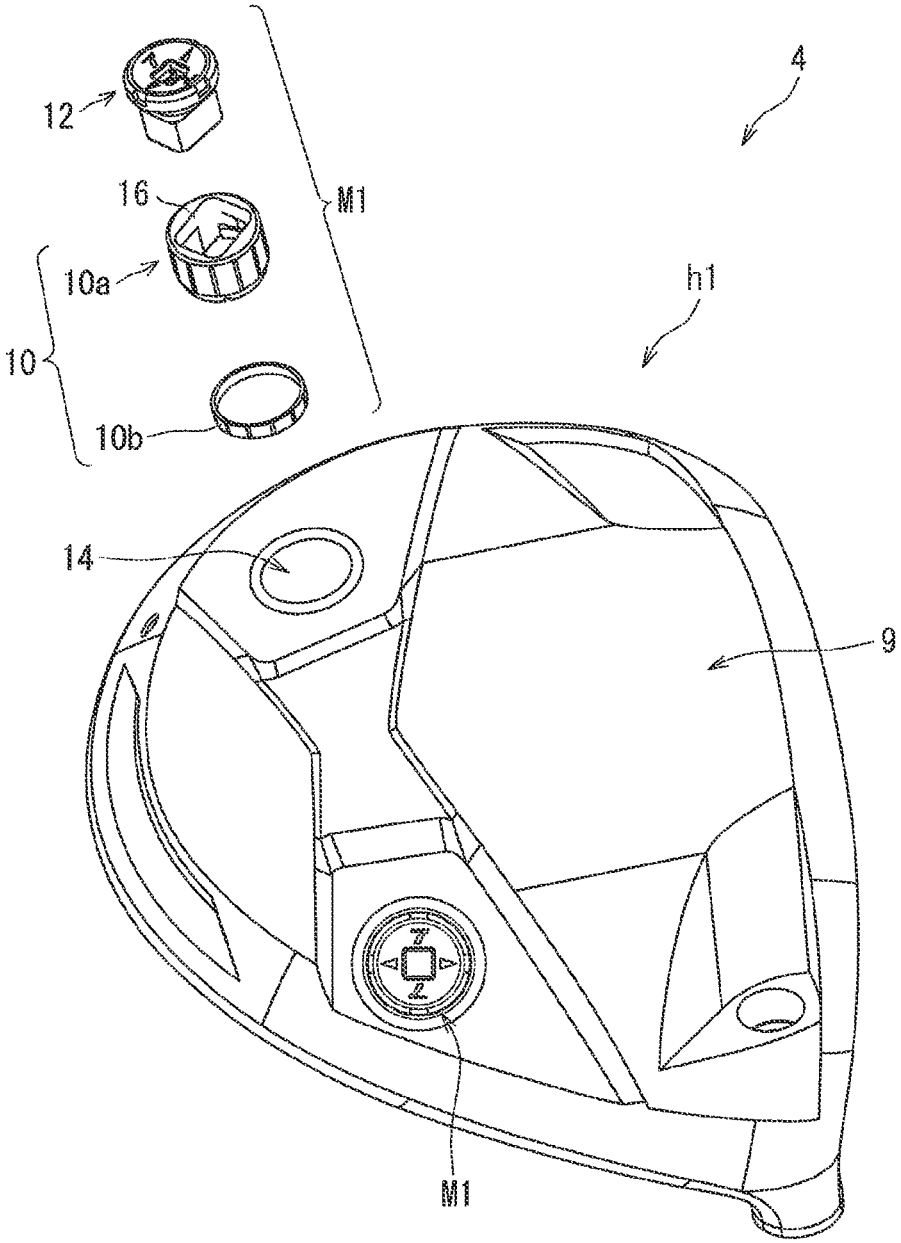
FIG. 2 is a perspective view of the head of FIG. 1, and includes an exploded perspective view of a weight body attaching/detaching mechanism.

FIG. 2 is a perspective view of the head 4 viewed from the sole 9 side. The head 4 includes a head body h1 and a weight body attaching/detaching mechanism M1. The head 4 includes a plurality of (two) weight body attaching/detaching mechanisms M1. FIG. 2 includes an exploded perspective view of the weight body attaching/detaching mechanism M1. One of the two weight body attaching/detaching mechanisms M1 is shown in the exploded perspective view.

As shown in FIG. 2, the weight body attaching/detaching mechanism M1 includes a socket 10 and a weight body 12. The head body h1 includes a socket housing part 14. The shape of the inner surface of the socket housing part 14 corresponds to the outer shape of the socket 10. The number of the socket housing parts 14 is the same as the number of the weight body attaching/detaching mechanisms M1. The number of the socket housing parts 14 is the same as the number of the sockets 10. In the embodiment, two socket housing parts 14 are provided. The number of the socket housing parts 14 may be 1, may be 2, and may be equal to or greater than 3. The number of the weight body attaching/detaching mechanisms M1 may be 1, may be 2, and may be equal to or greater than 3.

Figure 3:
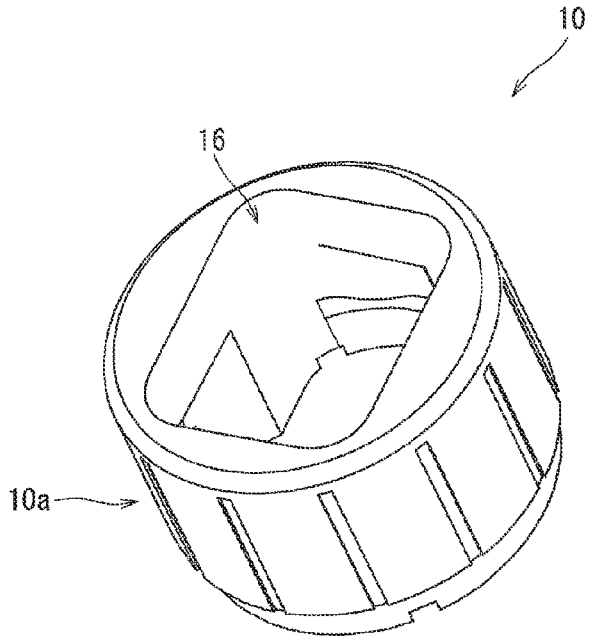
FIG. 3 is a perspective view of a socket.
Figure 4A:
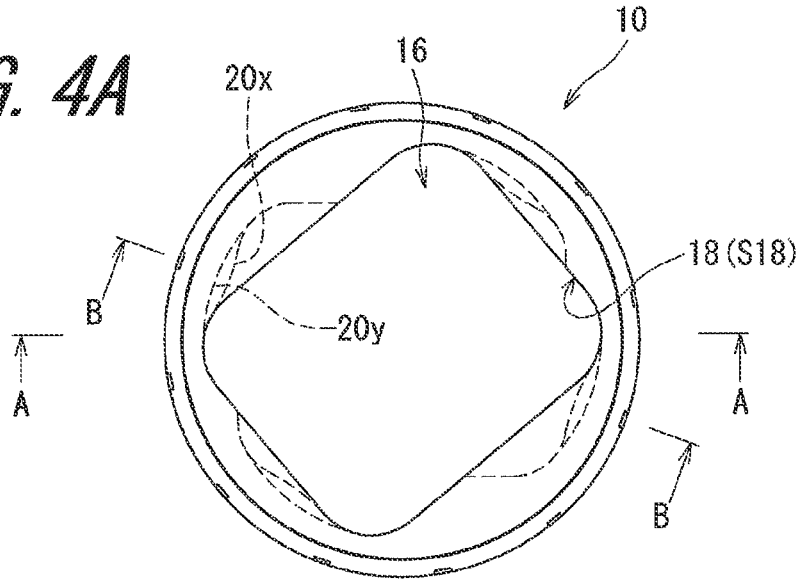
FIG. 4A is a plan view of the socket.
Figure 4B:
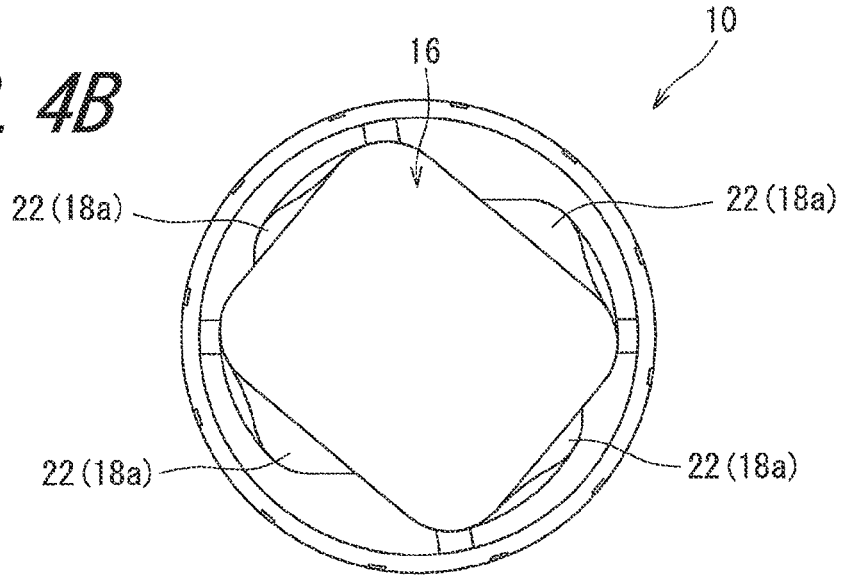
FIG. 4B is a bottom view of the socket.
Figure 5:
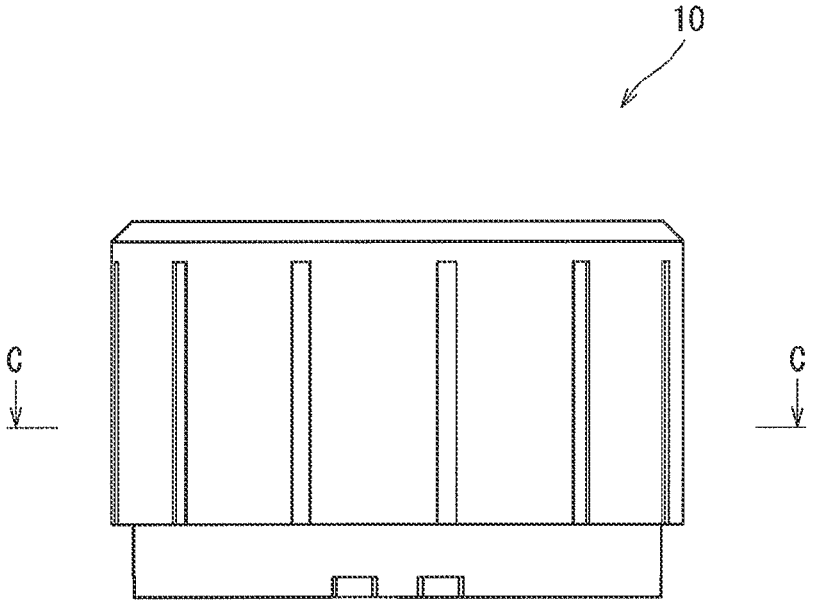
FIG. 5 is a side view of the socket.
Figure 6:
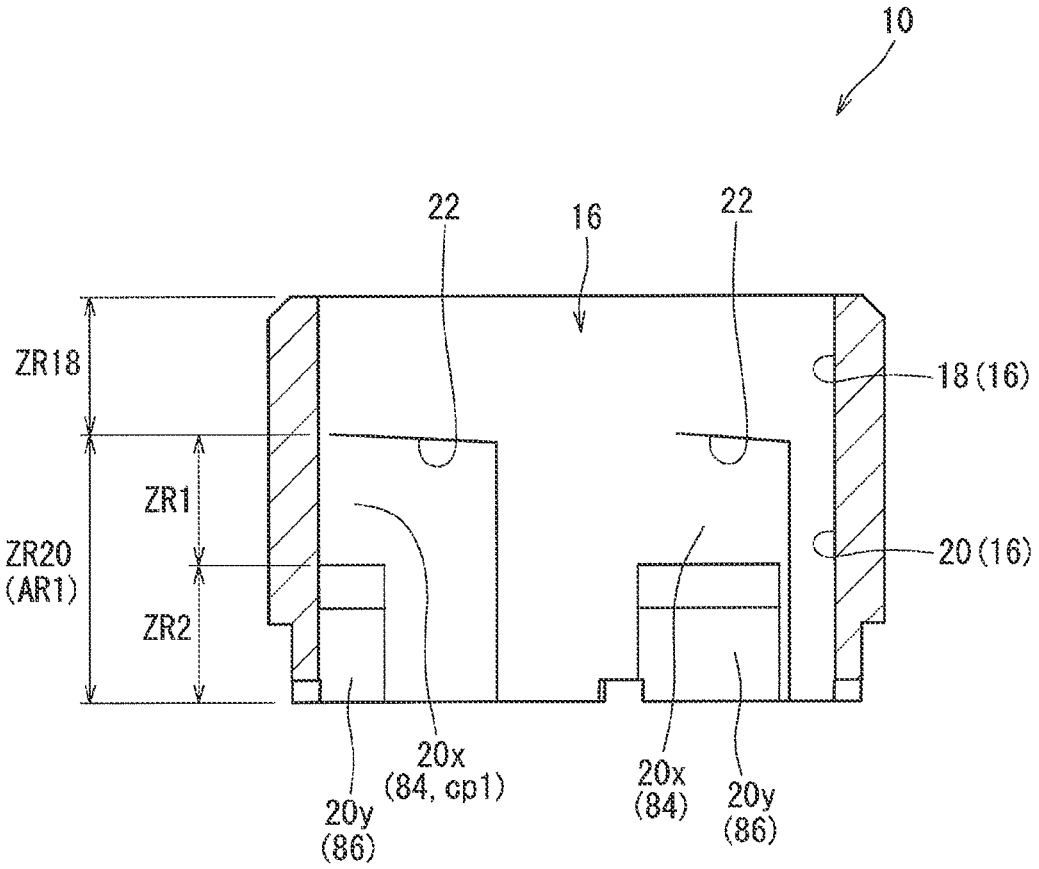
FIG. 6 is a cross-sectional view taken along line A-A of FIG. 4.
Figure 7:
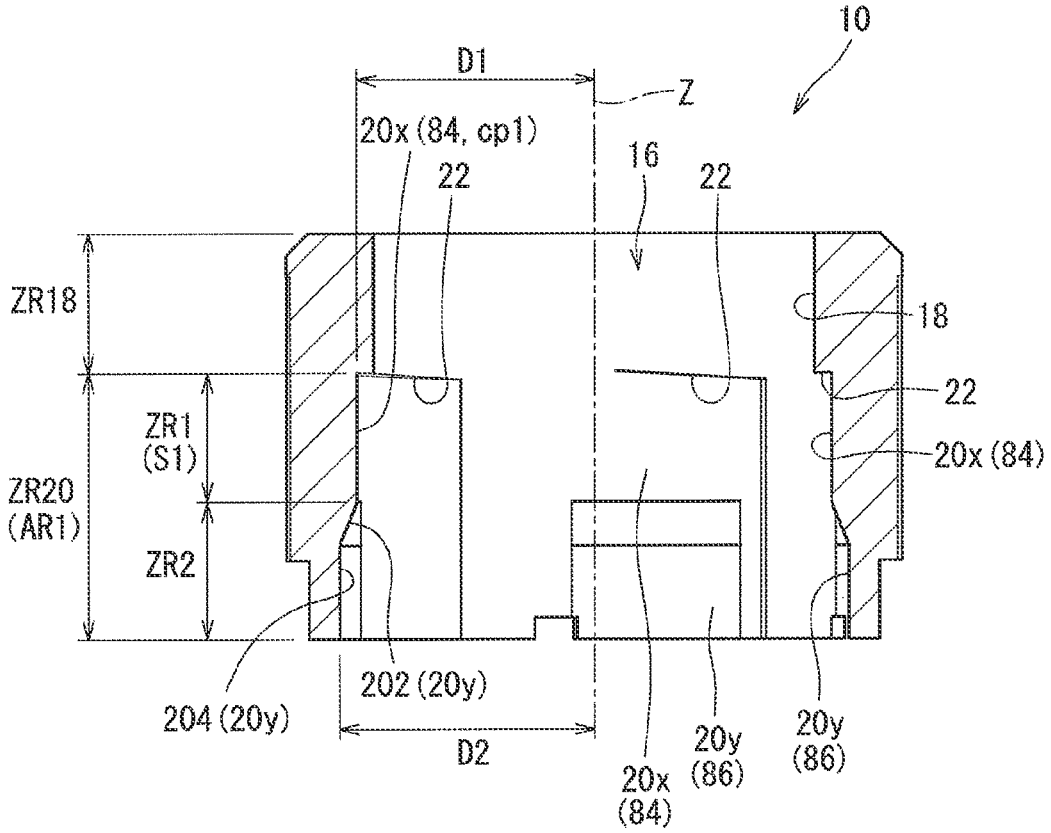
FIG. 7 is a cross-sectional view taken along line B-B of FIG. 4.
Figure 8:
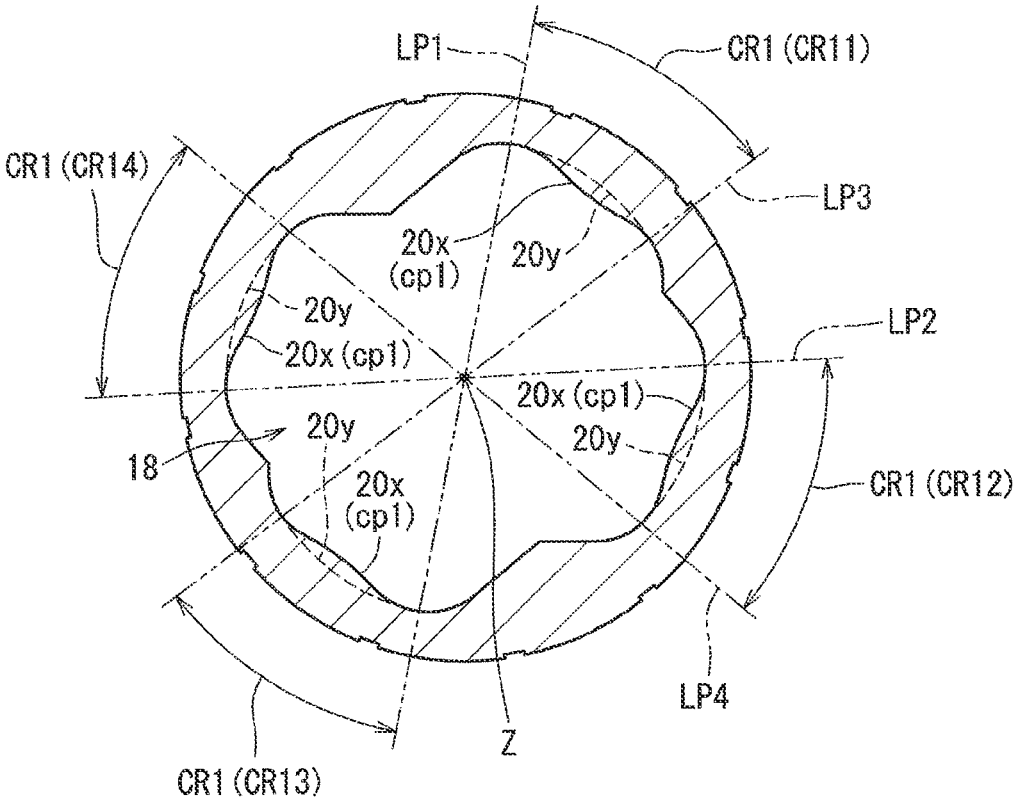
FIG. 8 is a cross-sectional view taken along line C-C of FIG. 5.

FIG. 3 is a perspective view of the socket 10. FIG. 4A is a plan view of the socket 10. FIG. 4B is a bottom view of the socket 10. FIG. 5 is a side view of the socket 10. FIG. 6 is a cross-sectional view taken along line A-A of FIG. 4. FIG. 7 is a cross-sectional view taken along line B-B of FIG. 4. FIG. 8 is a cross-sectional view taken along line C-C of FIG. 5.

The socket 10 is secured in the socket housing part 14. The securement is attained by an adhesive, for example. The socket 10 may be secured without an adhesive.

A body part 10*a* includes a hole 16. The hole 16 extends through the body part 10*a*.

The weight body 12 is detachably attached to the socket 10. Therefore, the weight body 12 is detachably attached to the head 4. The position of the center of gravity of the head can be changed by replacing the weight body 12. The weight of the head can be changed by replacing the weight body 12.

As shown in FIGS. 6 and 7, the hole 16 includes an upper hole part 18, a lower hole part 20, and an engaging bump surface 22. An axial-directional range in which the upper hole part 18 exists is shown by a double pointed arrow ZR18 in FIGS. 6 and 7. An axial-directional range in which the lower hole part 20 exists is shown by a double pointed arrow ZR20 in FIGS. 6 and 7. The lower hole part 20 is positioned on a deeper side (a lower side) of the upper hole part 18. The entire inner surface of the upper hole part 18 smoothly continues. In the embodiment, a sectional shape of the inner surface of the upper hole part 18 is a substantially rectangle (See FIGS. 4A and 4B). The substantially rectangle is a shape in which four corners of a rectangle is rounded. The sectional shape of the inner surface of the upper hole part 18 is substantially equal to a sectional shape of an engaging part 32 of the weight body 12.

In the present application, an "axial direction" means a direction of an axis line Z (to be described later). In the present application, a "circumferential direction" means a circumferential direction in a circumferential surface having the axis line Z as its center. The circumferential direction is the same as the moving direction of an outermost part E1 (to be described later).

As shown in FIG. 8, a sectional shape of an inner surface of the lower hole part 20 includes complicated unevenness. The details of the shape of the inner surface of the lower hole part 20 will be described later.

The sectional shape of the upper hole part 18 is different from the sectional shape of the lower hole part 20. Because of the difference, the engaging bump surface 22 is formed (see FIG. 4B). The engaging bump surface 22 is a downward surface.

The lower hole part 20 includes a first portion 20*x* and a second portion 20*y*. An axial-directional range in which the first portion 20*x* exists is shown by a double pointed arrow ZR1 in FIGS. 6 and 7. An axial-directional range in which the second portion 20*y* exists is shown by a double pointed arrow ZR2 in FIGS. 6 and 7. The details of the first portion 20*x* and the second portion 20*y* will be described later.

As shown in FIG. 2, the socket 10 includes a bottom face forming part 10*b*. The bottom face forming part 10*b* forms a bottom face part of the socket 10. The bottom face forming part 10*b* closes a lower side opening of the lower hole part 20. The bottom face forming part 10*b* can prevent the weight body 12 from contacting with the bottom part of the socket housing part 14. The bottom face forming part 10*b* may not exist. The bottom face forming part 10*b* may be integrally formed with another part of the socket 10.

The socket 10 is formed of a polymer. An elastic modulus Es of the polymer is lower than an elastic modulus Eh of a material forming the head body h1. Preferably, the material of the socket 10 is a resin. The lower hole part 20 of the socket 10 can be elastically deformed in association with a rotation of the weight body 12. The details of the elastic deformation will be described later.

Figure 9:
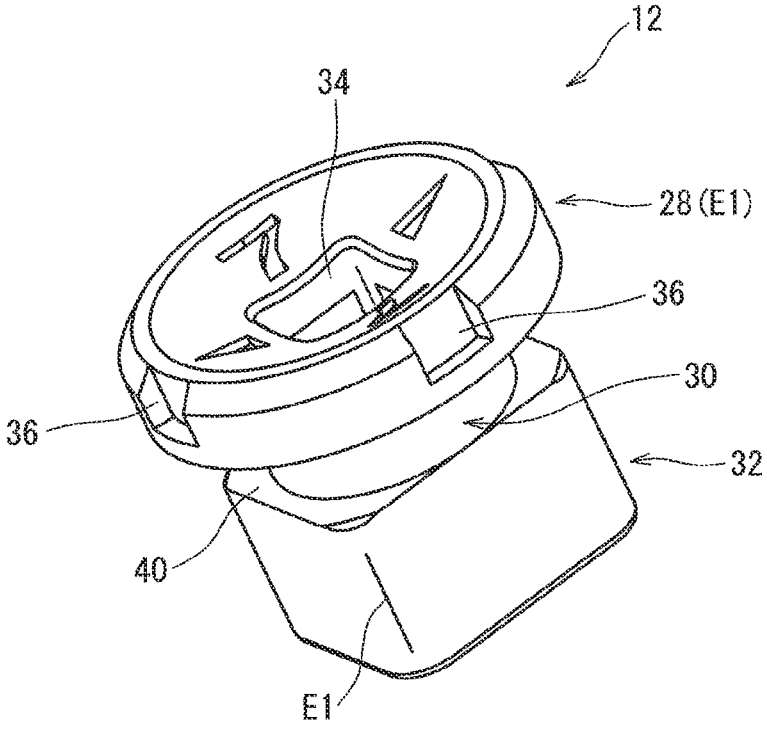
FIG. 9 is a perspective view of a weight body.
Figure 10A:
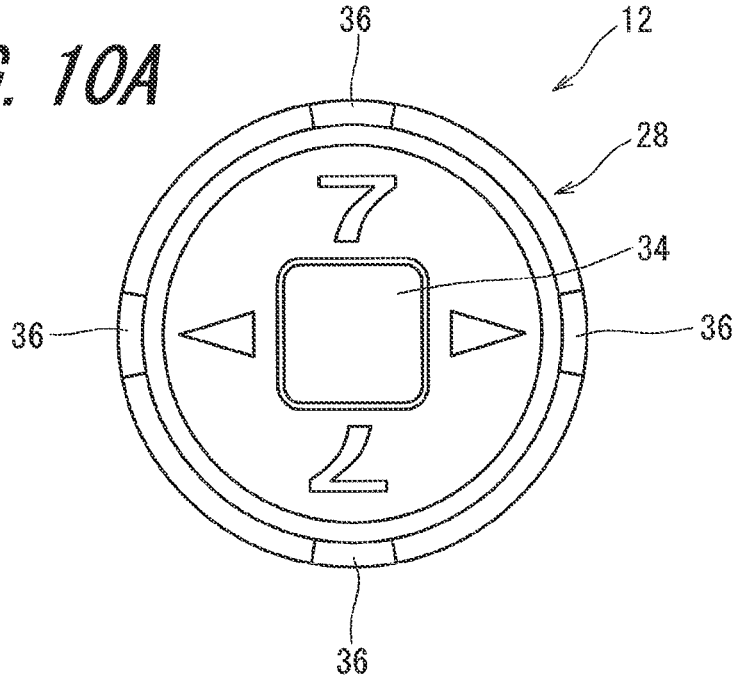
FIG. 10A is a plan view of the weight body.
Figure 10B:
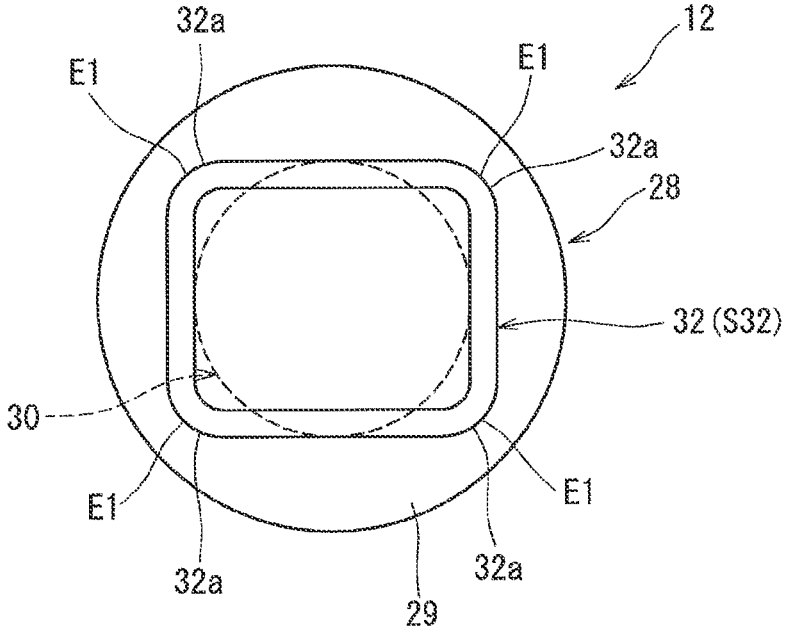
FIG. 10B is a bottom view of the weight body.
Figure 11A:
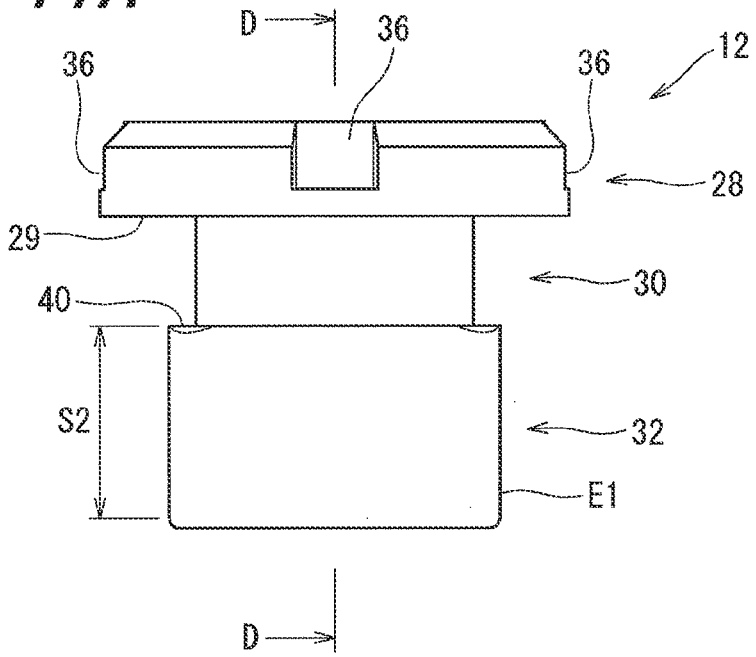
FIGS. 11A and 11B are side views of the weight body.
Figure 11B:
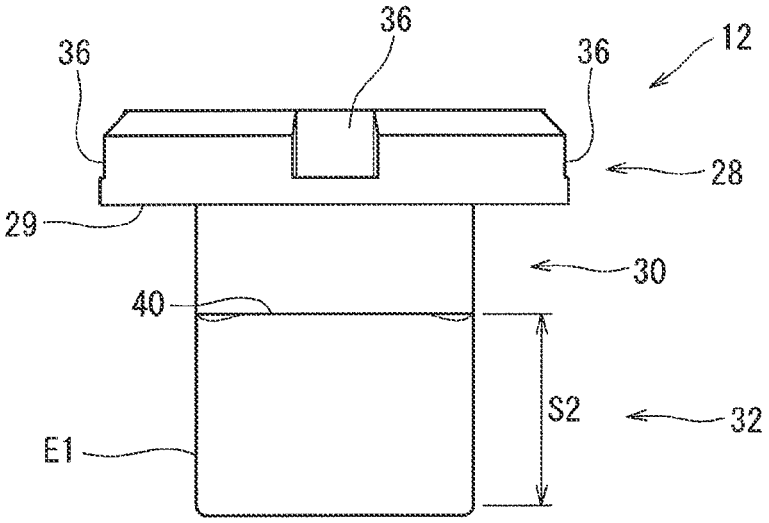
Figure 12:
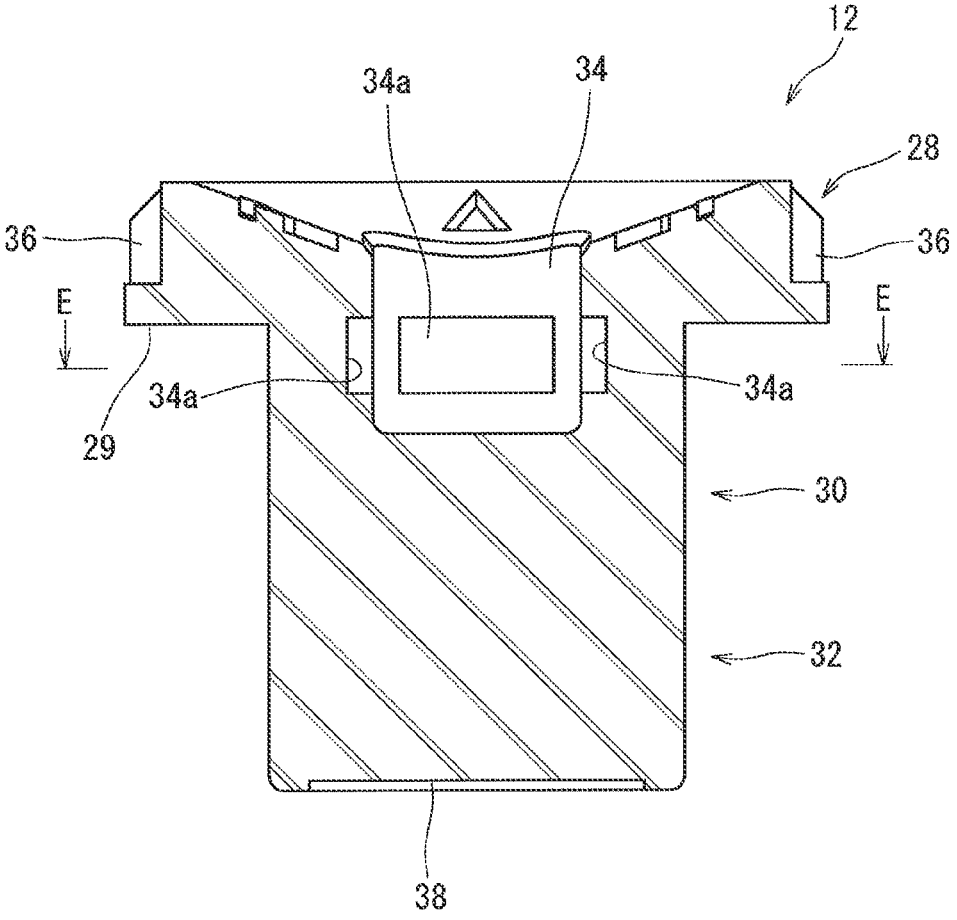
FIG. 12 is a cross-sectional view taken along line D-D of FIG. 11A.
Figure 13:
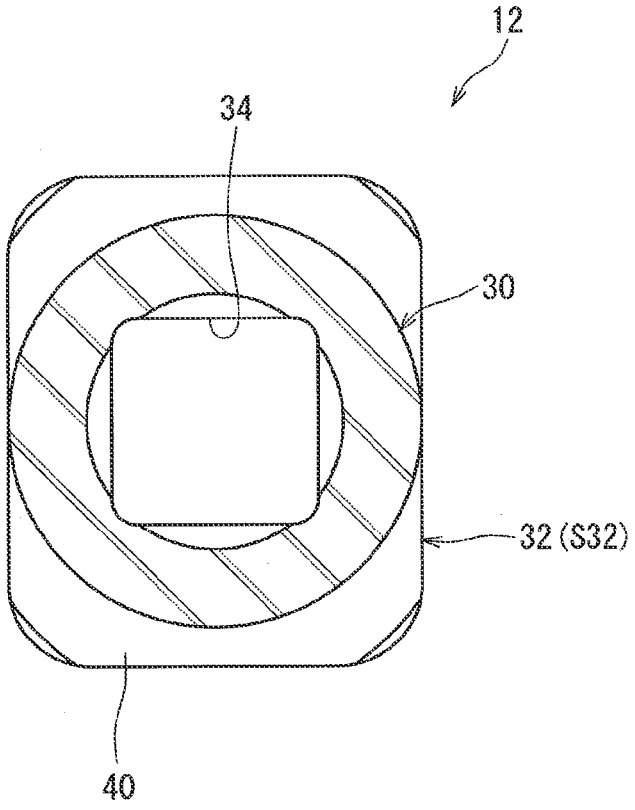
FIG. 13 is a cross-sectional view taken along line E-E of FIG. 12.

FIG. 9 is a perspective view of the weight body 12. FIG. 10A is a plan view of the weight body 12. FIG. 10B is a bottom view of the weight body 12. FIGS. 11A and 11B are side views of the weight body 12. The point of view of FIG. 11A is different by 90° from that of FIG. 11B. FIG. 12 is a cross-sectional view taken along line D-D of FIG. 11A. FIG. 13 is a cross-sectional view taken along line E-E of FIG. 12.

As shown in FIGS. 9, 11A, and 11B, the weight body 12 includes a head part 28, a neck part 30, and the engaging part 32. A noncircular hole 34 is formed at the center of the upper end face of the head part 28. In the embodiment, the noncircular hole 34 has a substantially quadrangle shape. A recess part 34*a* is provided on the inner surface of the noncircular hole 34 (see FIG. 12). A plurality of cutouts 36 are formed in the outer peripheral surface of the head part 28. The outer surface of the neck part 30 is a circumferential surface. The neck part 30 has a cylindrical shape. The upper face of the head part 28 is exposed to the outside in a state where the weight body 12 is secured to the socket 10.

The outer surface of the engaging part 32 has a noncircular sectional shape S32. As shown in FIGS. 10B and 13, in the embodiment, the sectional shape S32 is a substantially rectangle. A sectional shape S18 of the upper hole part 18 is shown in FIG. 4. The sectional shape S32 has a similarity relationship with the sectional shape S18. The sectional shape S32 of the engaging part 32 is (slightly) smaller than the sectional shape S18. The engaging part 32 can be inserted in the upper hole part 18.

As shown in FIG. 12, a recess part 38 is formed in the lower end face of the engaging part 32. The volume of the weight body 12 can be adjusted by the volume of a space formed by the recess part 38 without changing the outer shape of a portion engaged with the socket 10. Therefore, the mass of the weight body 12 can be easily adjusted.

As shown in FIG. 10B, the engaging part 32 includes a corner part 32*a*. A plurality of corner parts 32*a* is provided. In the embodiment, four corner parts 32*a* are provided. The corner part 32*a* forms a protruding part which protrudes to an axial perpendicular direction. The axial perpendicular direction is a direction intersecting the axis line Z at right angles (to be described later).

The engaging part 32 includes an engaging surface 40 (see FIGS. 9, 11A, and 13). The engaging surface 40 is formed by a difference between the sectional shapes of the engaging part 32 and the neck part 30. The engaging surface 40 is an upward surface. The engaging surface 40 is opposed to a lower surface 29 of the head part 28.

A specific gravity G2 of the weight body 12 is greater than a specific gravity G1 of the head body h1. The specific gravity G2 of the weight body 12 is greater than a specific gravity G3 of the socket 10. In respect of durability and a specific gravity, the material of the weight body 12 is preferably a metal. Examples of the metal include aluminum, an aluminium alloy, titanium, a titanium alloy, stainless steel, a tungsten alloy, and a tungsten nickel alloy (W—Ni alloy). An example of the titanium alloy is 6-4Ti (Ti-6Al-4V). An example of the stainless steel is SUS304.

Examples of a method for manufacturing the weight body 12 include forging, casting, sintering, and NC process. In the case of the aluminium alloy, the 6-4Ti, and the SUS304, the NC process is preferably performed after the casting. In the case of the W—Ni alloy, the NC process is preferably performed after the sintering or the casting. NC stands for "Numerical Control".

Figure 14:
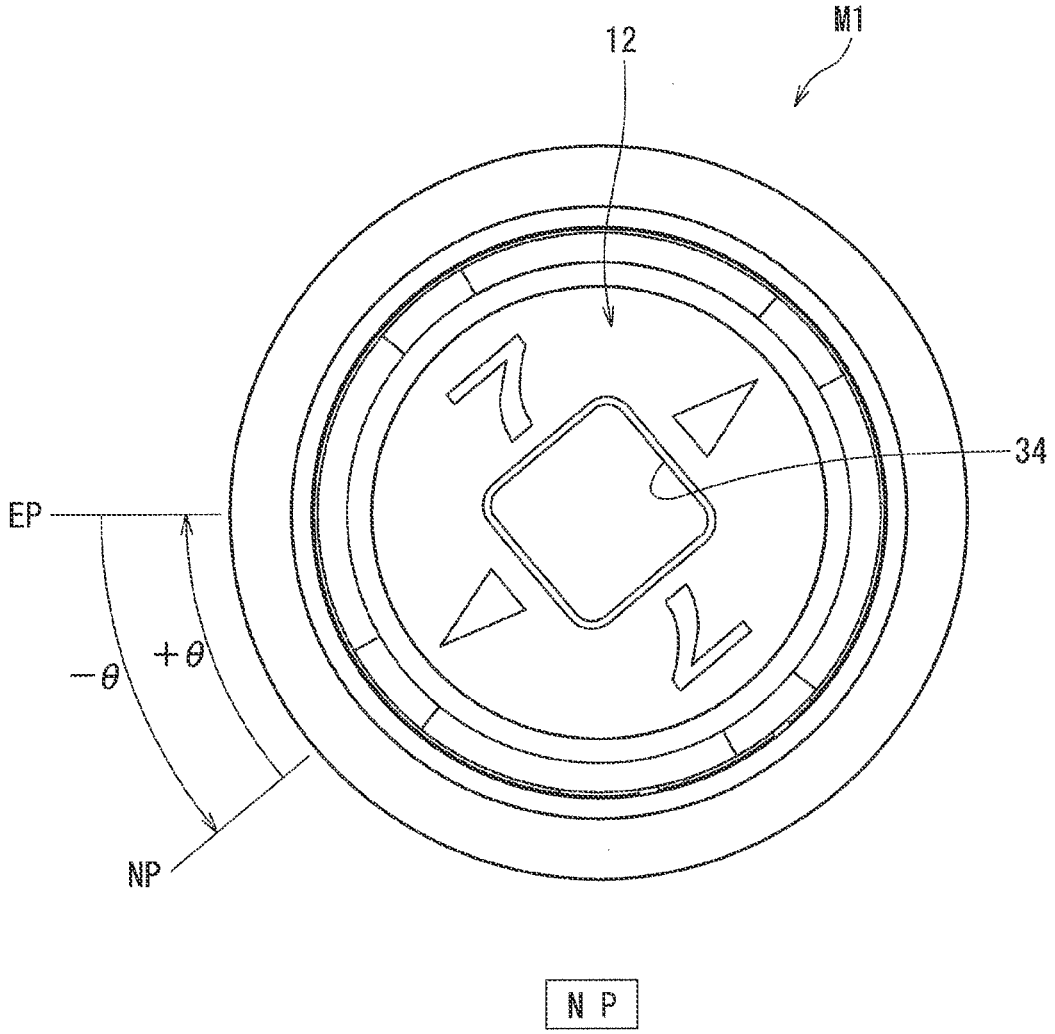
FIG. 14 is a plan view of the weight body attaching/detaching mechanism attached to a socket housing part, and is a view at a non-engaging position NP.
Figure 15:
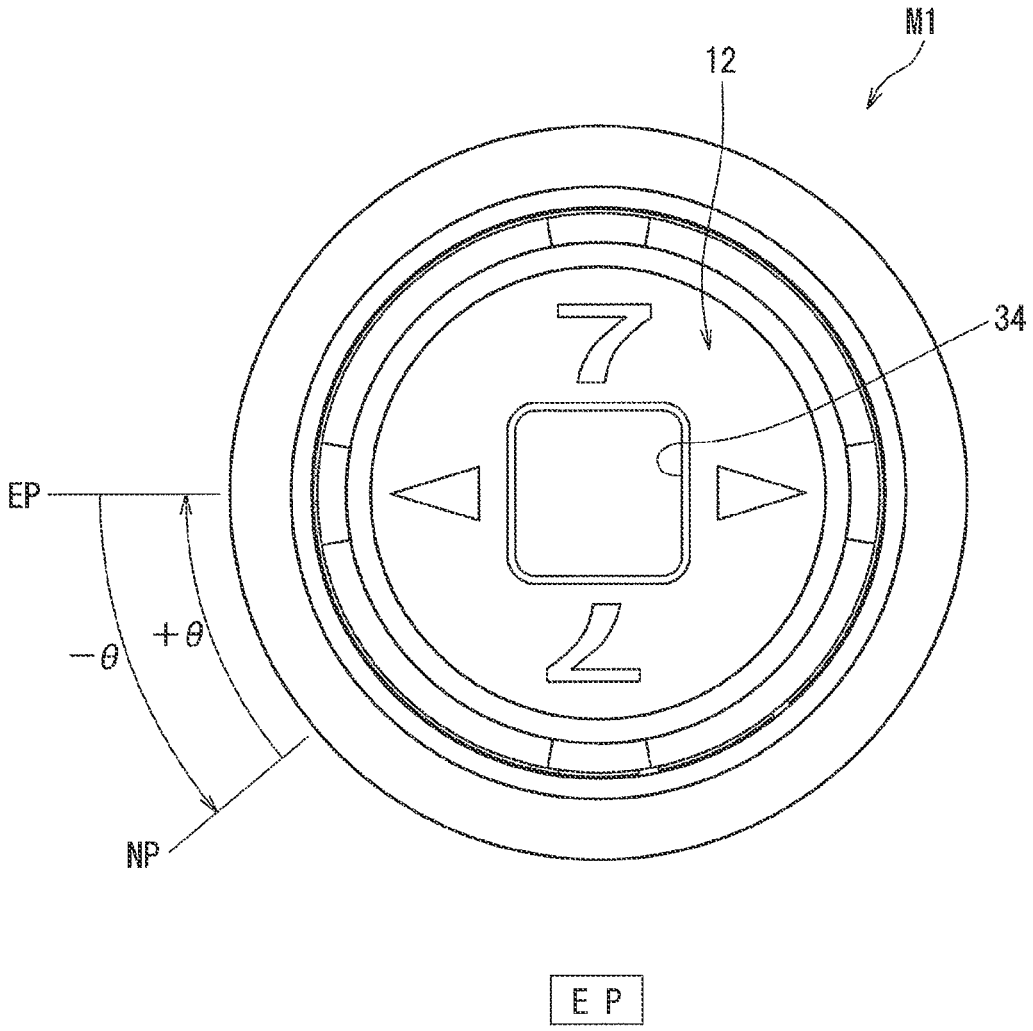
FIG. 15 is a plan view of the weight body attaching/detaching mechanism attached to the socket housing part, and is a view at an engaging position EP.

FIG. 14 is a plan view of the weight body attaching/detaching mechanism M1 at a non-engaging position NP. FIG. 15 is a plan view of the weight body attaching/detaching mechanism M1 at an engaging position EP.

The weight body 12 can be rotated with respect to the socket 10. By the relative rotation, the weight body 12 can take the non-engaging position NP and the engaging position EP.

At the non-engaging position NP, the weight body 12 can be extracted from the socket 10. At the non-engaging position NP, the weight body 12 is in an unlocked state.

Meanwhile, at the engaging position EP, the weight body 12 cannot be extracted from the socket 10. At the engaging position EP, the weight body 12 is secured to the socket 10. At the engaging position EP, the weight body 12 is in a locked state. In the club 2 in use, the weight body 12 is set to the engaging position EP. The weight body 12 which is in a locked state does not fall off.

At the time of inserting the weight body 12 into the socket 10, the weight body 12 is at the non-engaging position NP with respect to the socket 10. By the relative rotation of an angle θ, a transition of the position of the weight body 12 from the non-engaging position NP to the engaging position EP is made. By an inverse relative rotation of the angle θ, the weight body 12 is returned from the engaging position EP to the non-engaging position NP. The angle of the relative rotation for making the transition to the engaging position EP from the non-engaging position NP is also described as "+θ" in the present application. The angle of the relative rotation for making the transition to the non-engaging position NP from the engaging position EP is also described as "−θ" in the present application. Signs of "+" and "−" are assigned in order to show that rotation directions are opposite to each other. The unit of θ is degree. In the weight body attaching/detaching mechanism M1, the weight body 12 can be attached and detached by merely applying the rotation of the angle θ. The weight body attaching/detaching mechanism M1 has excellent easiness of attachment and detachment of the weight body 12.

In the embodiment, the angle θ is 40°. The angle θ is not limited to 40°. In light of the certainty of the securement, the angle θ is preferably equal to or greater than 20°, and more preferably equal to or greater than 30°. In light of the easiness of attachment and detachment, the angle θ is preferably equal to or less than 60°, and more preferably equal to or less than 50°.

A number is indicated in the weight body 12. The number shows the mass of the weight body 12. The weight body 12 is 7 g.

Figure 16:
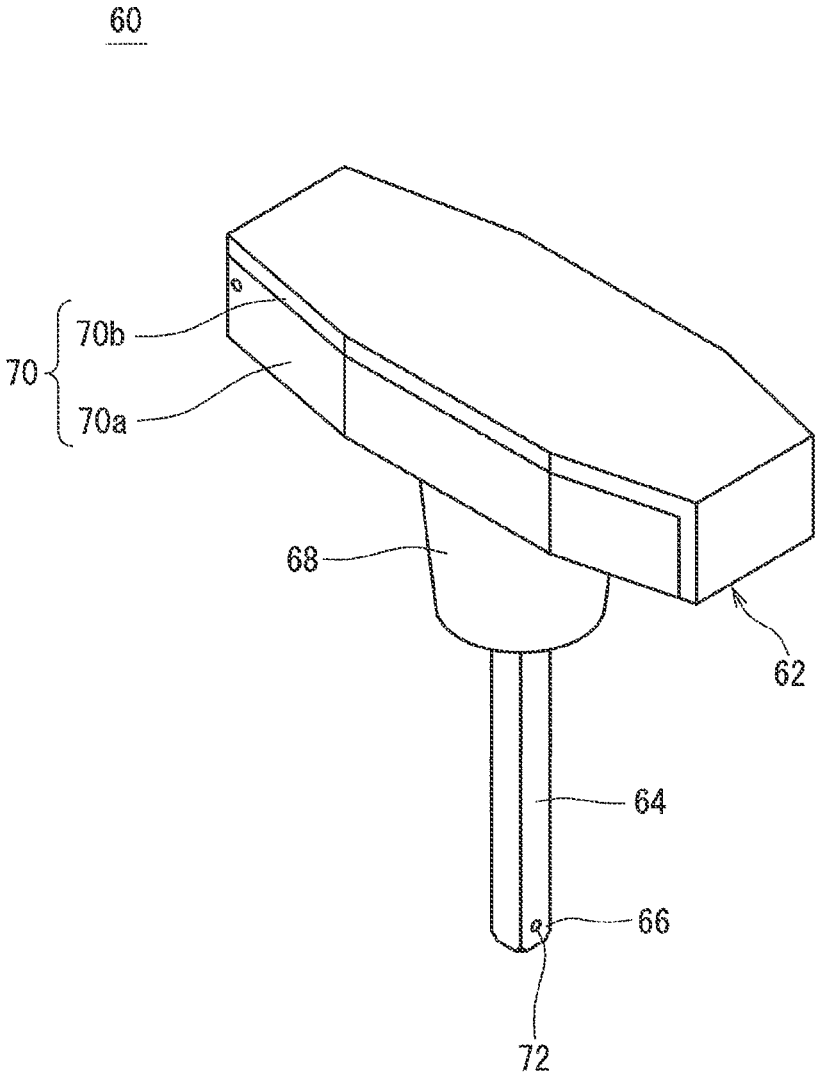
FIG. 16 is a perspective view showing an example of a tool for rotating the weight body.

An exclusive tool may be used to rotate the weight body 12. FIG. 16 is a perspective view showing an example of the tool 60. The tool 60 is a torque wrench. The tool 60 includes a handle 62, a shaft 64, and a tip part 66. The handle 62 includes a handle body 68 and a holding part 70. The holding part 70 includes a holding part body 70*a* and a lid 70*b*.

The back end part of the shaft 64 is secured to the holding part body 70*a*. The sectional shape of the tip part 66 of the shaft 64 corresponds to the sectional shape of the noncircular hole 34 of the weight body 12. In the embodiment, the tip part 66 has a quadrangle sectional shape. A pin 72 is provided on the tip part 66. The pin 72 protrudes from the side surface of the tip part 66. Although not shown in the drawings, an elastic body (coil spring) is built in the tip part 66. The pin 72 is biased in a protruding direction by the biasing force of the elastic body.

When the weight body 12 is attached/detached, the lid 70*b* is closed. A weight body housing part (not shown) is provided in the holding part body 70*a*. Preferably, the weight body housing part can house a plurality of weight bodies 12. The plurality of weight bodies 12 having different weights are preferably housed. The weight bodies 12 can be taken out by opening the lid 70*b*.

The tip part 66 of the tool 60 is inserted into the noncircular hole 34 of the weight body 12 when the weight body 12 is attached. The pin 72 presses the noncircular hole 34 while going backward according to the insertion. The weight body 12 is less likely to be disengaged from the tip part 66 by the pressing force. The pin 72 can enter into the recess part 34*a* (see FIG. 12) of the noncircular hole 34. The weight body 12 is less likely to be disengaged from the tip part 66 by the entering of the pin 72. The weight body 12 held by the shaft 64 of the tool 60 is inserted into the hole 16.

The engaging part 32 of the weight body 12 passes through the upper hole part 18 of the hole 16, and leads to the lower hole part 20. Immediately after the insertion, the weight body 12 is positioned at the non-engaging position NP.

The relative rotation of the angle +θ° is applied to the weight body 12 positioned at the non-engaging position NP. Specifically, the weight body 12 is rotated by the angle +θ° with respect to the socket 10 using the tool 60. The transition to the engaging position EP from the non-engaging position NP is attained by the rotation. Thus, the attachment of the weight body 12 is completed. The attachment of the weight body 12 is easy.

When the weight body 12 is detached, the reverse rotation of the angle θ° is performed. That is, the rotation of the angle −θ° is performed. The transition to the non-engaging position NP from the engaging position EP is attained by the rotation. The weight body 12 positioned at the non-engaging position NP can be extracted. As described above, the pin 72 can enter into the recess part 34*a* (see FIG. 12) of the noncircular hole 34. Because of the entering of the pin 72, the weight body 12 is still further easily extracted.

At the engaging position EP, the weight body 12 cannot be extracted from the hole 16. The extraction of the weight body 12 is inhibited by engaging the engaging bump surface 22 of the hole 16 with the engaging surface 40 of the weight body 12 at the engaging position EP. Therefore, the tool 60 can be easily extracted from the noncircular hole 34 of the weight body 12 at the engaging position EP.

Figure 17:
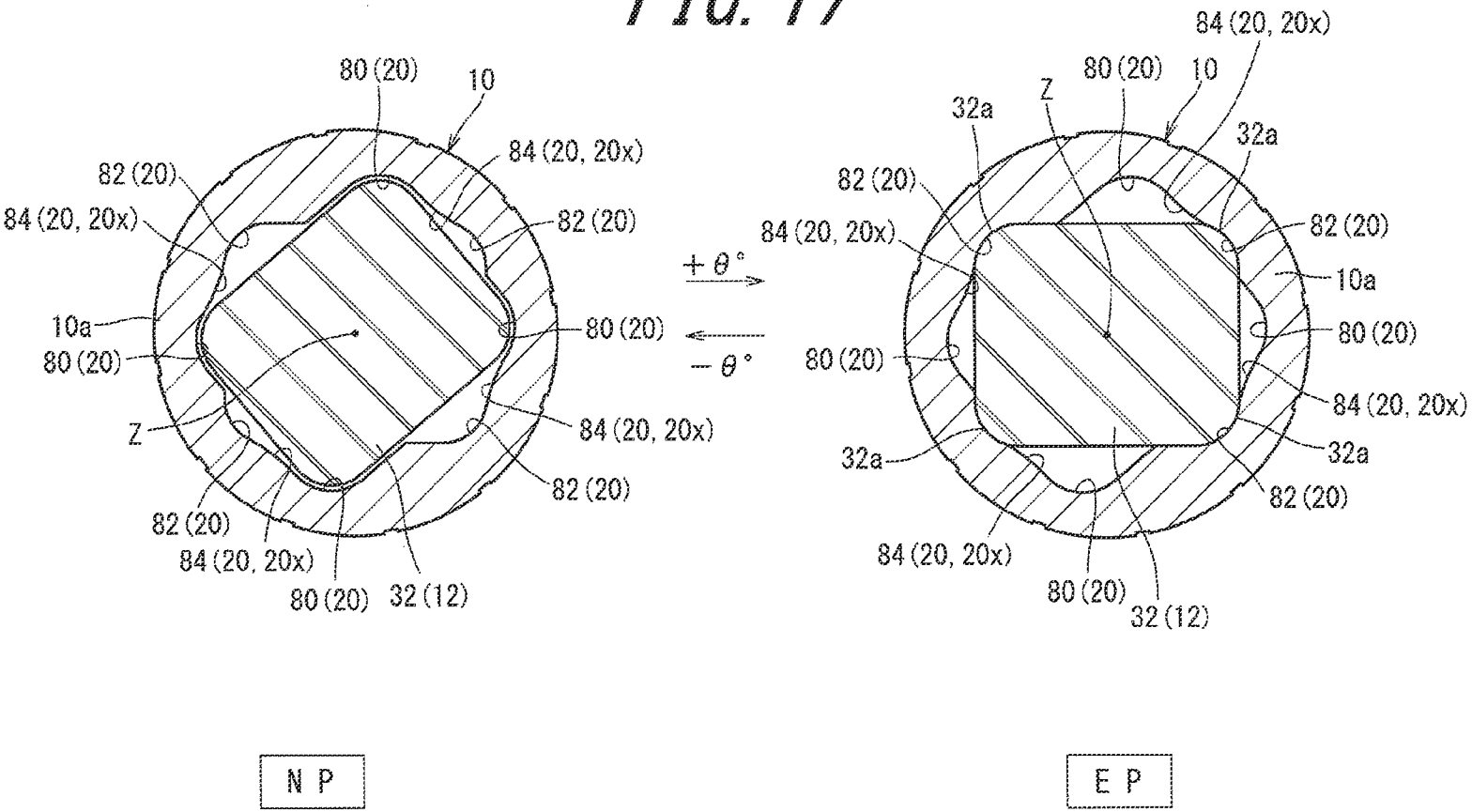
FIG. 17 is a cross-sectional view showing a lower hole part and an engaging part, is a cross-sectional view at a position in which a first portion exists, and shows the non-engaging position NP and the engaging position EP.

FIG. 17 is a cross-sectional view showing the engaging part 32 and the socket 10. FIG. 17 is a cross-sectional view at the axial-directional range ZR1 (See FIGS. 6 and 7) which is already described. A cross-sectional view at the non-engaging position NP is shown on the left side of FIG. 17. A cross-sectional view at the engaging position EP is shown on the right side of FIG. 17. The axis line Z which is the center axis of the rotation of the angle θ is shown by a point in FIG. 17. The center of figure of the section of the outline of the engaging part 32 is positioned on the axis line Z. The rotation of the weight body 12 in the relative rotation is rotation about the axis line Z.

As described above, at the non-engaging position NP, a clearance (play) exists between the engaging part 32 and the lower hole part 20. Therefore, in an initial stage of the relative rotation from the non-engaging position NP toward the engaging position EP, a deviation in the rotation axis line of the weight body 12 can be generated. However, in a last stage of the relative rotation from the non-engaging position NP toward the engaging position EP, the clearance (play) vanishes and the deviation of the rotation axis line of the weight body 12 is dissolved. Therefore, the axis line Z can be uniquely determined. Although the rotation axis of the weight body 12 can be slightly varied in every attaching work due to the elastic deformation of the socket 10, the axis line Z is defined as the most ideal rotational axis. When the rotation axis line of the weight body 12 is not unique, the axis line Z is defined as a center axis line of the weight body 12 at the engaging position EP.

As shown in FIG. 17, in the axial-directional range ZR1, the lower hole part 20 includes a non-engaging corresponding surface 80, an engaging corresponding surface 82, and a resistance surface 84. The non-engaging corresponding surface 80 is a surface corresponding to the engaging part 32 at the non-engaging position NP. The engaging corresponding surface 82 is a surface corresponding to the engaging part 32 at the engaging position EP. The resistance surface 84 is positioned between the non-engaging corresponding surface 80 and the engaging corresponding surface 82.

The resistance surface 84 is pressed by the engaging part 32 during the mutual transition of the non-engaging position NP and the engaging position EP. The pressing is mainly performed by the corner part 32*a*. A frictional force is generated between the engaging part 32 and the lower hole part 20 by the pressing. The resistance surface 84 is elastically deformed by the pressing. The frictional force is varied by the elastic modulus Es of the socket 10. The frictional force generates a rotation resistance. The increased frictional force generates an increased rotation resistance. Increasing the elastic modulus Es can increase the rotation resistance. A strong torque is required for the mutual transition of the non-engaging position NP and the engaging position EP by the increased rotation resistance. Therefore, the mutual transition does not easily take place. The transition from the engaging position EP to the non-engaging position NP is not generated by an impact force in hitting. The tool 60 is required for the mutual transition. The mutual transition cannot be attained with empty hands without using the tool 60. The weight body 12 positioned at the engaging position EP is not separated by strong impact shock in hitting.

When the elastic modulus Es is excessively great, excessive torque might be required for attaining the mutual transition. In light of the easiness of attachment, excessive torque is not preferable. The elastic modulus Es is set so that a torque required in the mutual transition is appropriate.

In the mutual transition, a torque required to rotate the weight body 12 is local maximum when the resistance surface 84 is elastically deformed. The torque required to rotate the weight body 12 is local maximum during the mutual transition. Therefore, the transition to the non-engaging position NP from the engaging position EP does not easily take place. The local maximum torque contributes to the prevention of the separation of the weight body 12 during play.

As shown in FIG. 17, the resistance surface 84 includes a convex-like part. The convex-like part protrudes toward the center of the socket 10. The convex-like part is formed by a smooth curved surface. The rotation resistance generated during the mutual transition is increased by the convex-like part. The convex-like part can effectively suppress the release of the engaging position EP.

The resistance surface 84 may not be a convex-like part. For example, the resistance surface 84 may be flat. In respect of increasing the value of the local maximum of the torque, the resistance surface 84 is preferably a convex-like part.

Thus, the weight body 12 can be attached by merely performing the relative rotation of the angle θ in the weight body attaching/detaching mechanism M1. Furthermore, the weight body 12 can be detached by merely performing the relative rotation of the angle θ.

In the embodiment, the resistance surface 84 is the first portion 20*x*. The first portion 20*x* is pressed by the engaging part 32 during the relative rotation. The pressing causes the first portion 20*x* to be elastically deformed. The elastic deformation is a compressive deformation and restoration from the compressive deformation. A maximum deformation is brought by the outermost part E1. The outermost part E1 will be described later.

The engaging part 32 does not deform the lower hole part 20 at the non-engaging position NP. As shown in the left view of FIG. 17, at the non-engaging position NP, a clearance exists between the engaging part 32 and the lower hole part 20. Therefore, the weight body 12 is easily inserted and taken out at the non-engaging position NP. Meanwhile, as shown in the right view of FIG. 17, at the engaging position EP, all the corner parts 32*a* adhere to the lower hole part 20 without clearance. At the adhered portion, the engaging corresponding surface 82 is pressed by the corner part 32*a*. The lower hole part 20 is elastically deformed by the pressing. The lower hole part 20 is extended by the elastic deformation. The distance between the two engaging corresponding surfaces 82 opposed to each other is extended by the elastic deformation. The size of the engaging part 32 and the size of the lower hole part 20 are determined so that the distance can be extended. The weight body 12 is secured by the restoring force of the elastic deformation.

Thus, in the weight body attaching/detaching mechanism M1, the following constitutions A and B are attained. By the constitution A, the weight body 12 is still further certainly secured. In addition, attaching/detaching work is facilitated by the constitution B.

[Constitution A]: At the engaging position EP, the engaging part 32 elastically deforms the socket 10, and the lower hole part 20 is extended by the elastic deformation.

[Constitution B]: At the non-engaging position NP, the engaging part 32 does not elastically deform the socket 10.

As described above, the socket 10 includes the upper hole part 18 and the lower hole part 20. The sectional shape of the upper hole part 18 is different from that of the lower hole part 20. The difference in the sectional shape causes the formation of the engaging bump surface 22.

As shown in FIG. 4A and FIG. 4B, the upper hole part 18 includes a held part 18*a*. The lower surface of the held part 18*a* is the engaging bump surface 22.

At the non-engaging position NP, the held part 18*a* is not engaged with the weight body 12. Meanwhile, at the engaging position EP, the held part 18*a* is engaged with the weight body 12. At the engaging position EP, the held part 18*a* is sandwiched between the lower surface 29 and the engaging surface 40. In other words, at the engaging position EP, the held part 18*a* is held by the weight body 12. Therefore, the weight body 12 is certainly secured.

As shown in FIGS. 6 and 7, the engaging bump surface 22 is inclined. The inclination causes a change in the axial-directional thickness of the held part 18*a*. The axial-directional thickness of the held part 18*a* is gradually changed. As the weight body 12 is rotated to the engaging position EP, the maximum value of the axial-directional thickness of a portion held by the weight body 12 is increased. At the engaging position EP, the held part 18*a* is compressively deformed so that the axial-directional thickness is decreased. As the weight body 12 is rotated to the engaging position EP, the compressive deformation is increased. At the engaging position EP, a pressing force is applied to the lower surface 29 and the engaging surface 40 from the held part 18*a* by the restoring force of the compressive deformation. For this reason, the vibration of the weight body 12 is suppressed so that the weight body 12 is still further certainly secured.

Figure 18:
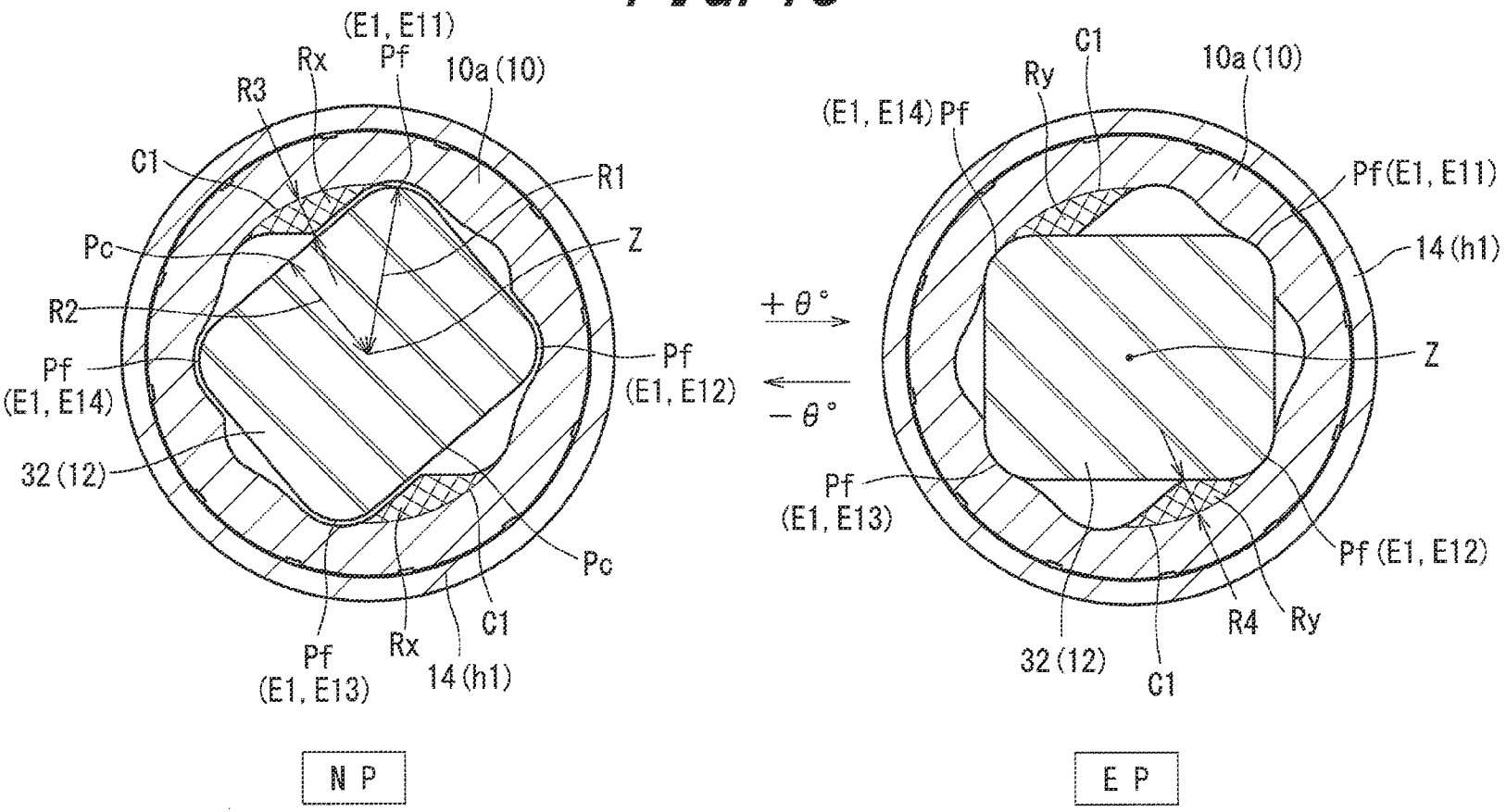
FIG. 18 is a cross-sectional view of the weight body attaching/detaching mechanism, and shows the non-engaging position NP and the engaging position EP.

FIG. 18 is a cross-sectional view of the weight body attaching/detaching mechanism M1. The position of the cross-section is the same as FIG. 17. The left side in FIG. 18 is a cross-sectional view at the non-engaging position NP. The right side in FIG. 18 is a cross-sectional view at the engaging position EP.

The left side in FIG. 18 is the cross-sectional view at the non-engaging position NP. A portion shown by crosshatching in the cross-sectional view at the non-engaging position NP is a reverse rotation suppressing part Rx. A circular arc C1 determining the reverse rotation suppressing part Rx is a part of a circle including the axis line Z as a central point, wherein a distance between the central point Z and a point Pf is defined as a radius R1. The point Pf is the point farthest from the point Z in the outline of the section of the engaging part 32. The reverse rotation suppressing part Rx can prevent reverse rotation in locking. The reverse rotation suppressing part Rx prompts correct rotation (rotation of +θ°) to the engaging position EP. That is, the effect of promotion of the correct rotation is exhibited.

The right side in FIG. 18 is the cross-sectional view at the engaging position EP. A portion shown by crosshatching in the cross-sectional view at the engaging position EP is an excess rotation suppressing part Ry. The circular arc C1 determining the excess rotation suppressing part Ry is as described above. The excess rotation suppressing part Ry can prevent excess rotation in locking. The excess rotation suppressing part Ry suppresses further excess rotation of the engaging part 32 beyond the engaging position EP when the engaging part 32 lead to the engaging position EP. The excess rotation suppressing part Ry prompts the attainment of the engaging position EP. The effect of suppression of the excess rotation is exhibited by the excess rotation suppressing part Ry.

In the embodiment, the reverse rotation suppressing part Rx and the excess rotation suppressing part Ry are large and high. Therefore, the effects of promotion of the correct rotation and suppression of the excess rotation are high. In the embodiment, the projection part forming the excess rotation suppressing part Ry is also the reverse rotation suppressing part Rx. However, when the weight body 12 is at the engaging position EP, the excess rotation suppressing part Ry is compressed by the engaging part 32, and is slightly deformed. Meanwhile, when the weight body 12 is at the non-engaging position NP, the compressive deformation is not generated in the reverse rotation suppressing part Rx. A projection part forming the excess rotation suppressing part Ry and a projection part forming the reverse rotation suppressing part Rx may be separately provided each other.

Figure 19:
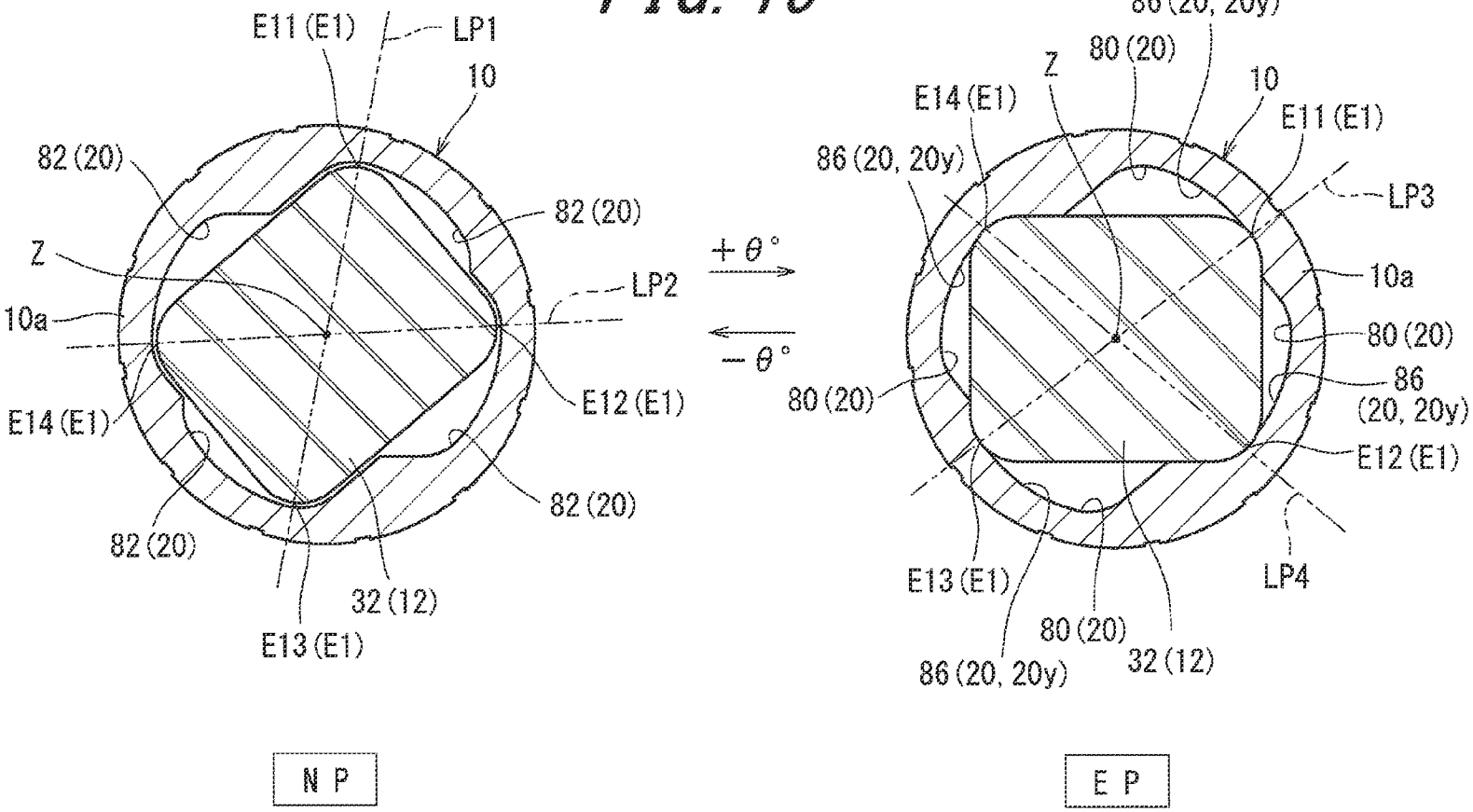
FIG. 19 is a cross-sectional view showing the lower hole part and the engaging part.

FIG. 19 is a cross-sectional view showing the engaging part 32 and the socket 10. FIG. 19 is a cross-sectional view at the axial-directional range ZR2 which is already described (See FIGS. 6 and 7). FIG. 19 is the cross-sectional view at the axial-directional range ZR2, meanwhile FIG. 17 is the cross-sectional view at the axial-directional range ZR1.

A cross-sectional view at the non-engaging position NP is shown on the left side in FIG. 19. A cross-sectional view at the engaging position EP is shown on the right side in FIG. 19. The axis line Z which is the center axis of the rotation of the angle θ is shown by a point in FIG. 19. The center of figure of the section of the engaging part 32 is positioned on the axis line Z. The rotation of the weight body 12 in the relative rotation is rotation about the axis line Z.

As shown in FIG. 19, in the axial-directional range ZR2, the lower hole part 20 includes a non-engaging corresponding surface 80, an engaging corresponding surface 82, and a non-contact surface 86. The non-engaging corresponding surface 80 is a surface corresponding to the engaging part 32 at the non-engaging position NP. The engaging corresponding surface 82 is a surface corresponding to the engaging part 32 at the engaging position EP. The non-contact surface 86 is positioned between the non-engaging corresponding surface 80 and the engaging corresponding surface 82.

As described above, the resistance surface 84 is provided in the axial-directional range ZR1. The resistance surface 84 is a surface of the first portion 20*x*. On the other hand, the non-contact surface 84 is provided in the axial-directional range ZR2, instead of the resistance surface 84. In the embodiment, the non-contact surface 86 is the surface of the second portion 20*y*.

As shown in FIGS. 6 and 7, in the embodiment, the second portion 20*y* is provided on the lower side of the first portion 20*x*. The second portion 20*y* may be provided on the upper side of the first portion 20*x*.

The engaging part 32 includes the outermost part E1. The outermost part E1 is a portion farthest from the rotation axis line Z of the weight body 12. In the embodiment, the outermost part E1 is a ridge line which exists on each of four corner parts 32*a* (See FIGS. 9 and 10B). In the embodiment, the outermost part E1 is a straight line. The outermost part E1 is a gathering of the points Pf (See FIG. 18) which is already described. The outermost part E1 is parallel to the axis line Z.

The outermost part E1 may be a line as in the embodiment, a point, or a surface. When the outermost part E1 is a surface, the outermost part E1 is typically a surface along the circumferential direction. The outermost part E1 may be a straight line as in the embodiment, or a curved line.

As described above, the first portion 20*x* is compressed by the engaging part 32. The first portion 20*x* includes a compressive deformation part cp1 which can be compressively deformed by the outermost part E1 (See FIGS. 6, 7 and 8). The compressive deformation part cp1 is compressively deformed in the process of the relative rotation. The second portion 20*y* is provided on the lower side of the compressive deformation part cp1. The second portion 20*y* may be provided on the upper side of the compressive deformation part cp1. The resistance surface 84 already described is a surface of the compressive deformation part cp1. A part of the first portion 20*x* may be the compressive deformation part cp1. The entire first portion 20*x* may be the compressive deformation part cp1.

In the present application, a passing region of the outermost part E1 is defined. The passing region is a region set on the inner surface of the lower hole part 20. The passing region means a region which the outermost part E1 can be opposed to or contact with in the relative rotation of the angle θ. The term "oppose" means to oppose in the axis perpendicular direction. The passing region includes a region which the outermost part E1 at the engaging position EP can be opposed to or contact with.

The engaging part 32 includes four outermost parts E1. As shown in FIG. 18, the engaging part 32 includes a first outermost part E11, a second outermost part E12, a third outermost part E13 and a fourth outermost part E14 as the outermost parts E1.

A circumferential range of the passing region is shown by a double pointed arrow CR1 in FIG. 8. The range CR1 exists on four places in the circumferential direction so as to correspond to each of the four outermost parts E1. A first circumferential-directional range CR11 is a circumferential passing range of the first outermost part E11. A second circumferential-directional range CR12 is a circumferential passing range of the second outermost part E12. A third circumferential-directional range CR13 is a circumferential passing range of the third outermost part E13. A fourth circumferential-directional range CR14 is a circumferential passing range of the fourth outermost part E14.

FIG. 8 shows a first virtual plane LP1, a second virtual plane LP2, a third virtual plane LP3 and a fourth virtual plane LP4. These virtual planes LP1 to LP4 are shown by a two-dot chain line.

These virtual planes LP1 to LP4 are also shown in FIG. 19.

As shown in FIG. 19, the first virtual plane LP1 and a second virtual plane LP2 are virtual planes at the non-engaging position NP. The first virtual plane LP1 is a plane including the first outermost part E11 and the third outermost part E13. The second virtual plane LP2 is a plane including the second outermost part E12 and the fourth outermost part E14.

As shown in FIG. 19, the third virtual plane LP3 and the fourth virtual plane LP4 is virtual planes at the engaging position EP. The third virtual plane LP3 is a plane including the first outermost part E11 and the third outermost part E13. The fourth virtual plane LP4 is a plane including the second outermost part E12 and the fourth outermost part E14.

In FIG. 8, these four virtual planes LP1 to LP4 are put together in a figure. The first circumferential-directional range CR11 is positioned between the first virtual plane LP1 and the third virtual plane LP3. The second circumferential-directional range CR12 is positioned between the second virtual plane LP2 and the fourth virtual plane LP4. The third circumferential-directional range CR13 is positioned between the first virtual plane LP1 and the third virtual plane LP3. The fourth circumferential-directional range CR14 is positioned between the second virtual plane LP2 and the fourth virtual plane LP4.

An axial-directional range of the passing region is shown by a double pointed arrow AR1 in FIGS. 6 and 7. Since the weight does 12 does not move in the axial direction, the outermost part E1 does not move in the axial direction, either. In the embodiment, all of the axial-directional ranges AR1 of four outermost parts E1 are the same. The axial-directional range AR1 is the same as the position of the outermost part E1 of the weight body 12 at a static state.

In the embodiment, the axial-directional range AR1 is the same as the axial-directional range ZR20 of the lower hole part 20 (See FIGS. 6 and 7).

In the embodiment, the passing region is determined in the circumferential direction and the axial direction. That is, the passing region is a region in which the circumferential-directional range is the range CR1 and the axial-directional range is the range AR1.

In the embodiment, four passing regions are determined each corresponding to the four outermost parts E1. The four passing regions are as follows.

(1) A first passing region is a region in which the circumferential-directional range is the range CR11 and the axial-directional range is the range AR1.

(2) A second passing region is a region in which the circumferential-directional range is the range CR12 and the axial-directional range is the range AR1.

(3) A third passing region is a region in which the circumferential-directional range is the range CR13 and the axial-directional range is the range AR1.

(4) A fourth passing region is a region in which the circumferential-directional range is the range CR14 and the axial-directional range is the range AR1.

The lower hole part 20 includes the first portion 20*x* and the second portion 20*y*. The first portion 20*x* and the second portion 20*y* are provided on the passing region. In the embodiment, the first portion 20*x* and the second portion 20*y* are provided on all of the four passing regions. It is sufficient that at least one of the plurality of passing regions includes the first portion 20*x* and the second portion 20*y*.

A distance between the first portion 20*x* and the rotation axis line Z is shown by a double pointed arrow D1 in FIG. 7. A distance between the second portion 20*y* and the rotation axis line Z is shown by a double pointed arrow D2 in FIG. 7. The distance D1 and the distance D2 are measured along the axial perpendicular direction.

In the embodiment, the following configuration (a1) is established. In other words, in the embodiment, the following configuration (b1) is established.

(a1) In the same circumferential position, the distance D2 is greater than the distance D1.

(b1) In the same axial-directional section, the distance D2 is greater than the distance D1.

The axial-directional section means a section made by a plane including the axis line Z. There are numerous sections made by the plane.

As is obvious from FIG. 8, the distance D1 and the distance D2 are varied depending on the circumferential position. For this reason, the distance D1 is compared with the distance D2 in the same circumferential position. In this respect, the configuration (a1) defines "the same circumferential position". Similarly, the configuration (b1) defines "the same axial-directional section".

By the configuration (a1), the rotation resistance of the weight body 12 in the relative rotation is reduced as compared with a case where the second portion 20*y* is substituted with the first portion 20*x*. That is, a part of the first portion 20*x* is substituted with the second portion 20*y*, and thereby the rotation resistance is reduced. In the embodiment, the following effect A is exhibited.

[Effect A]: The rotation resistance is reduced. In other words, a torque required for the correct rotation is reduced.

Because of the effect A, the attachment and detachment of the weight body 12 can be easy. Therefore, convenience can be improved.

In the embodiment, the configuration (a1) is established in any circumferential position. Therefore, the effect A is still further improved.

Because of the effect A, torque difference can be extended. The torque difference means a difference between a torque of generating the excess rotation or the reverse rotation and a torque required for the correct rotation. By a great torque difference, users are easy to recognize whether a rotation is the correct rotation or not. By the torque difference, users are easy to recognize the weight body 12 is at the engaging position EP. The torque difference can promote the correct rotation, and suppress the excess rotation and the reverse rotation.

As shown in FIG. 7, the distance D1 of the first portion 20*x* is constant in the axial-directional section. The first portion 20*x* is an axis parallel part which is parallel to the axis line Z. In the embodiment, the entire first portion 20*x* is the axis parallel part. However, as shown in FIG. 8 and the like, complicated unevenness is formed as the shape of the inner surface of the upper hole part 18, and the distance D1 is varied depending on the circumferential position.

As shown in FIG. 7, in the axial-directional section, the second portion 20*y* includes a slope part 202 and an axis parallel part 204. In the slope part 202, the distance D2 is increased as going to the lower side. The axis parallel part 204 is parallel to the axis line Z.

A axial-directional section shown in FIG. 7 is an example of embodiments for the first portion 20*x* and the second portion 20*y*. The first portion 20*x* and the second portion 20*y* may not include an axis parallel part.

Of the second portion 20*y*, the axis parallel part 204 is the non-contact surface 86. The axis parallel part 204 does not contact with the outermost part E1 in the process of the relative rotation of the angle θ. The axis parallel part 204 does not apply the rotation resistance to the weight body 12. The axis parallel part 204 enhances the effect A.

The second portion 20*y* may contact with the outermost part E1 . The second portion 20*y* may be compressively deformed by the outermost part E1 . As described above, the distance D2 is greater than the distance D1 . Therefore, the rotation resistance is small as compared with a case where the second portion 20*y* is substituted with the first portion 20*x*. Therefore, the effect A is exhibited also in this case.

In order to reduce the rotation resistance, instead of providing the second portion 20*y* as described above, the following virtual configuration (c1) can be adopted.

(c1) In the entire resistance surface 84, a distance D3 from the rotation axis line Z is increased.

For example, the distance D3(not shown) can be set to a value between the distance D1 and D2 . For example, the distance D3can be set to a value which is less than the distance D2 and greater than the distance D1 . The configuration (c1) also reduces the rotation resistance. However, the configuration (a1) has some advantages as compared with the configuration (c1).

In comparison with the virtual configuration (c1), the configuration (a1) can enhance stability of the weight body 12 at the engaging position EP. The reason is explained as follows.

As shown in FIGS. 17, 18 and 19, at the engaging position EP, the weight body 12 is secured by adhesion with the lower hole part 20. At the adhered portion, the lower hole part 20 is compressively deformed, and the engaging part 32 is pressed by restoring force of the deformation. The four corner parts 32*a* are pressed so that the weight body 12 is stably secured.

In the virtual configuration (c1), since the distance D3 is greater than the distance D1 , the amount of compressive deformation of the lower hole part 20 is small. Thus, the pressing force is small. On the other hand, in the configuration (a1), since the distance D1 is small, the amount of compressive deformation of the lower hole part 20 is great. Thus, the pressing force is great. Stable securement of the weight body 12 is attained by the great pressing force. That is, in the embodiment, the following effect B is exhibited.

[Effect B]: In the engaging position EP, the weight body 12 is stably secured by a great pressing force.

By the great amount of the compressive deformation, the corner part 32*a* dents the lower hole part 20. By a physical engagement of the corner part 32 and the dent, a rotation suppressing effect can be generated. By the rotation suppressing effect, stable securement of the weight body 12 is attained. That is, in the embodiment, the following effect C is exhibited.

[Effect C]: Because of the great amount of compressive deformation, physical engagement at the engaging position EP is enhanced. By the physical engagement, the rotation suppressing effect is enhanced.

The effect C also contributes to stable securement of the weight body 12.

As described above, in the embodiment, great pressing force can be generated. On the other hand, in the embodiment, the second portion 20*y* exists. The second portion 20*y* includes the non-contact surface 86, and the non-contact surface 86 does not apply a pressing force. In comparison of pressed areas, the area of the virtual configuration (c1) is greater than that of the configuration (a1).

Regardless of the small pressed area, in the embodiment, the weight body 12 can be stably secured as compared with the virtual configuration (c1). Reasons include the effect C as its first reason, and an effect of dimension error as its second reason.

The first reason (effect C) is explained as follows. If the amount of the compressive deformation is small even when an area in which the compressive deformation occurs is large, the effect of the physical engagement is small. The effect of enhancing the physical engagement can surpass the effect of decreasing the pressed area.

The second reason (dimension error) is explained as follows. In general, dimension error essentially occurs in a manufactured product. The dimension error occurs also in the lower hole part 20. The amount of compressive deformation can be decreased by the dimension error. When the decrease of the amount of the compressive deformation is considered as a ratio, the embodiment is advantageous as compared with the virtual configuration (c1). That is, when the absolute value of the decreased amount of the compressive deformation due to the dimension error is considered as constant, the decrease ratio of the embodiment is less than that of the virtual configuration (c1). This is because, in the embodiment, the design value of the amount of the compressive deformation which is the denominator for calculating the ratio is great. In addition, when the design value of the amount of the compressive deformation is small, the amount of the compressive deformation can be zero due to a small dimension error. On the other hand, when the design value of the amount of the compressive deformation is great, the amount of the compressive deformation is less likely to be zero due to the dimension error. Thus, in the embodiment, the effect of the dimension error can be reduced as compared with the virtual configuration (c1).

Here, an initial compressive deformation, an amount of the initial compressive deformation, and an initial pressing force are defined. The initial compressive deformation means a compressive deformation generated in an initial stage of a rotation from the engaging position EP to the non-engaging position NP. The initial compressive deformation is generated when the lower hole part 20 is deformed by the engaging part 32. The amount of the initial compressive deformation means a dimension of the initial compressive deformation. The initial pressing force means a pressing force generated by the initial compressive deformation.

A moment of start of rotation of the weight body 12 from the engaging position EP to the non-engaging position NP is also referred to as a rotation start phase. In the rotation start phase, the initial compressive deformation can be generated. In the rotation start phase, the initial pressing force can be generated.

The rotation start phase has an effect on the stability of securement of the weight body 12. For example, whether the weight body 12 easily shakes or not can depend on difficulty of rotation in the rotation start phase. If the rotation of the weight body 12 can be regulated in the rotation start phase, as a result, the weight body 12 is stably secured.

Because of the same reason as the above described effect B, the following effect D can be generated in the rotation start phase. Because of the same season as the above described effect C, the following effect E can be generated in the rotation start phase. These effects D and E also contribute to the stability of securement of the weight body 12.

[Effect D]: In the rotation start phase, a great pressing force is applied to the weight body 12.

[Effect E]: In the rotation start phase, the physical engagement is enhanced, and thereby the rotation suppressing effect is enhanced.

In addition, the embodiment has design easiness. The existence of the second portion 20*y* eases the design of the lower hole part 20. In the design of the resistance surface 84, a predetermined torque value is set as the rotation resistance. Since a slight difference in dimension can largely change the torque value, the design of the resistance surface 84 is not easy. In the embodiment, the torque value is adjusted by adjusting the axial-directional length of the second portion 20*y*. Therefore, the adjustment of the torque value is easy. Thus, the embodiment can exhibit the following effect F.

[Effect F]: By providing the second portion 20*y*, the adjustment of the rotation resistance easy. Therefore, the design of the lower hole part 20 is easy.

By the second portion 20*y*, the rotation resistance can be constant regardless of the axial-directional length of the engaging part 32. A axial-directional length of a portion in which the engaging part 32 contacts with the lower hole part 20 can be constant regardless of the axial-directional length of the engaging part 32. This is made possible by providing the non-contact surface 86 in the second portion 20*y*. Thus, the embodiment can exhibit the following effect G.

[Effect G]: Regardless of the axial-directional length of the engaging part 32, the rotation resistance can be constant.

When the rotation resistance is excessive, the detachment is difficult. When the rotation resistance is excessively small, stability of the securement can be deteriorated. In respect of achieving both easiness of the detachment and stability of the securement, it is preferable to set the rotation resistance appropriately. Meanwhile, by changing the axial-directional length of the engaging part 32, the mass of the weight body 12 can be easily changed. By a plurality of weight bodies 12 having a mass different from each other, the weight of the head and the position of the center of gravity of the head can be changed. By the effect G, the degree of freedom of adjusting the mass of the weight body 12 can be enhanced while suppressing variation of the rotation resistance. The effect G can provide high utility in actual use as a golf club.

In the embodiment, the first portion 20*x* is positioned on the upper side of the second portion 20*y*. In other words, the second portion 20*y* is position on the lower side of the first portion 20*x*. For this reason, inhibition of the rotation by a foreign substance is suppressed. The reason of this is explain as follows.

The foreign substance is, for example, shavings generated by wear of the socket 10. The shavings can be generated by repetition of the attachment and detachment of the weight body 12. Examples of other foreign substances include lawn, sand and dirt. When the weight body 12 is detached, the hole 16 is opened to the outside. In this time, a foreign substance such as lawn can enter the lower hole part 20. The entered foreign substance can accumulate in the lower hole part 20. The foreign substance can enter into between the engaging part 32 and the lower hole part 20. When a foreign substance is interposed on a contact part between the engaging part 32 and the lower hole part 20, difficulty of the relative rotation can arise. Thus, inhibition of the rotation by a foreign substance can arise.

In the embodiment, the inhibition of the rotation by the foreign substance is effectively suppressed. When the weight body 12 is attached and detached, users generally have the weight body 12 with a head part 28 thereof as the upper side in the vertical direction and with the engaging part 32 thereof as the lower side in the vertical direction. This is in order to easily perform the rotation work of the weight body 12. In the golf club 2, the weight body attaching/detaching mechanism M1 is attached to the sole 9. For example, for the attachment of the weight body 12, users put a grip end of the golf club 2 on the ground, and aim the sole 9 at upper side in the vertical direction.

Therefore, when the weight body 12 is rotated, the second portion 20*y* is apt to be lower side in the vertical direction with respect to the first portion 20*x*. In this case, the foreign substance entered in the lower hole part 20 is moved toward the second portion 20*y* due to gravity. The moved foreign substance can be housed in a space formed between the engaging part 32 and the second portion 20*y*. Since the foreign substances accumulated in this space, the foreign substances are less likely to move to between the engaging part 32 and the first portion 20*x*. Therefore, the inhibition of the rotation due to foreign substances is less likely to occur. The second portion 20*y* is positioned on the lower side of the first portion 20*x*, and thereby the inhibition of the rotation due to foreign substances is suppressed.

As shown in FIG. 7, the first portion 20*x* extends toward the axial direction. An axial-directional length of the first portion 20*x* is shown by a double pointed arrow S1 in FIG. 7.

In the embodiment, the length S1 is equal to an axial-directional length of the compressive deformation part cp1. An axial-directional length of the outermost part E1 is shown by a double pointed arrow S2 in FIGS. 11A and 11B. The outermost part E1 also extends along the axial direction. By the contact of the outermost part E1 and the first portion 20*x*, the rotation axis of the weight body 12 is apt to coincide with the center axis of the socket 10. This suppresses a rotation in a state where the weight body 12 is inclined so that partial wear of the lower hole part 20 is less likely to occur. In light of suppressing partial wear of the socket 10, the ratio (S1/S2) is preferably equal to or greater than 0.3, more preferably equal to or greater than 0.4, and still more preferably equal to or greater than 0.5. In light of suppressing the rotation resistance, the ratio (S1/S2) is preferably equal to or less than 0.9, more preferably equal to or less than 0.8, and still more preferably equal to or less than 0.7.

Figure 20A:
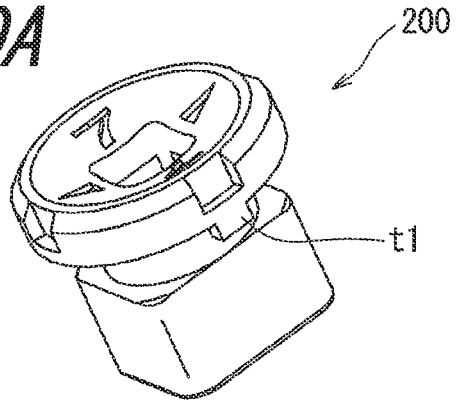
FIG. 20A is a perspective view of a weight body according to a second embodiment.
Figure 20B:
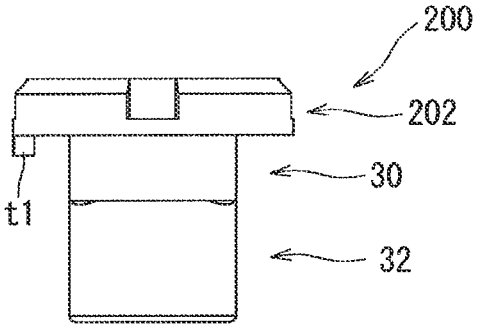
FIGS. 20B and 20C are side views of the weight body.
Figure 20C:
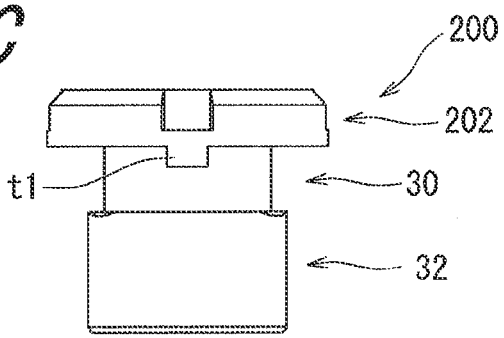

FIG. 20A is a perspective view of a weight body 200 according to the second embodiment. FIGS. 20B and 20C are side views of the weight body 200. The point of view of FIG. 20B is different by 90° from that of FIG. 20C. The weight body 200 includes a head part 202, a neck part 30 and an engaging part 32. The head part 202 includes a protrusion t1. The protrusion t1 extends from a lower surface of the head part 202 toward a lower side. The protrusion t1 is provided on one place in the circumferential direction. The protrusion t1 may be provided on a plurality of places in the circumferential direction. The protrusion t1 is positioned at an outer peripheral part of the head part 202. The difference between the head part 202 and the above described head part 28 is only the existence or non-existence of the protrusion t1. The difference between the weight body 200 and the above described weight body 12 is only the existence or non-existence of the protrusion t1.

The protrusion t1 is an example of the first rotation regulating part.

Figure 21A:
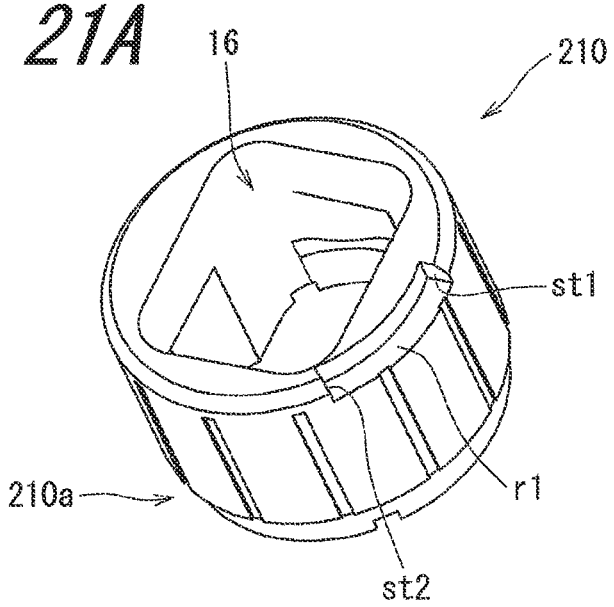
FIG. 21A is a perspective view of a socket according to the second embodiment.
Figure 21B:
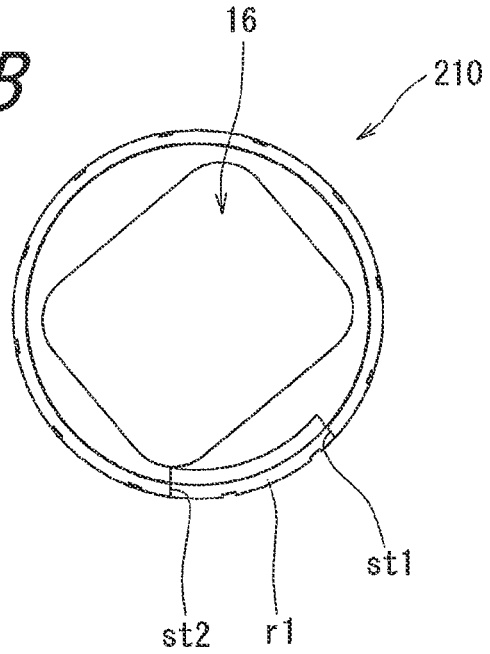
FIG. 21B is a plan view of the socket.

FIG. 21A is a perspective view of a socket 210 according to the second embodiment. FIG. 21B is a plan view of the socket 210. The socket 210 includes a body part 210*a*. The body part 210*a* includes a hole 16 and a recess part r1. The recess part r1 is formed on a peripheral part of the body part 210*a*. The recess part r1 is formed on a corner part of an upper side of the body part 210*a*. The recess part r1 extends along the circumferential direction. The recess part r1 includes a first stopper surface st1 and a second stopper surface st2. The difference between the socket 210 and the above described socket 10 is only the existence or non-existence of the recess part r1.

The recess part r1 is provided on one place in the circumferential direction. The recess part r1 may be provided on a plurality of places in the circumferential direction.

The recess part r1 is an example of the second rotation regulating part.

Figure 22:
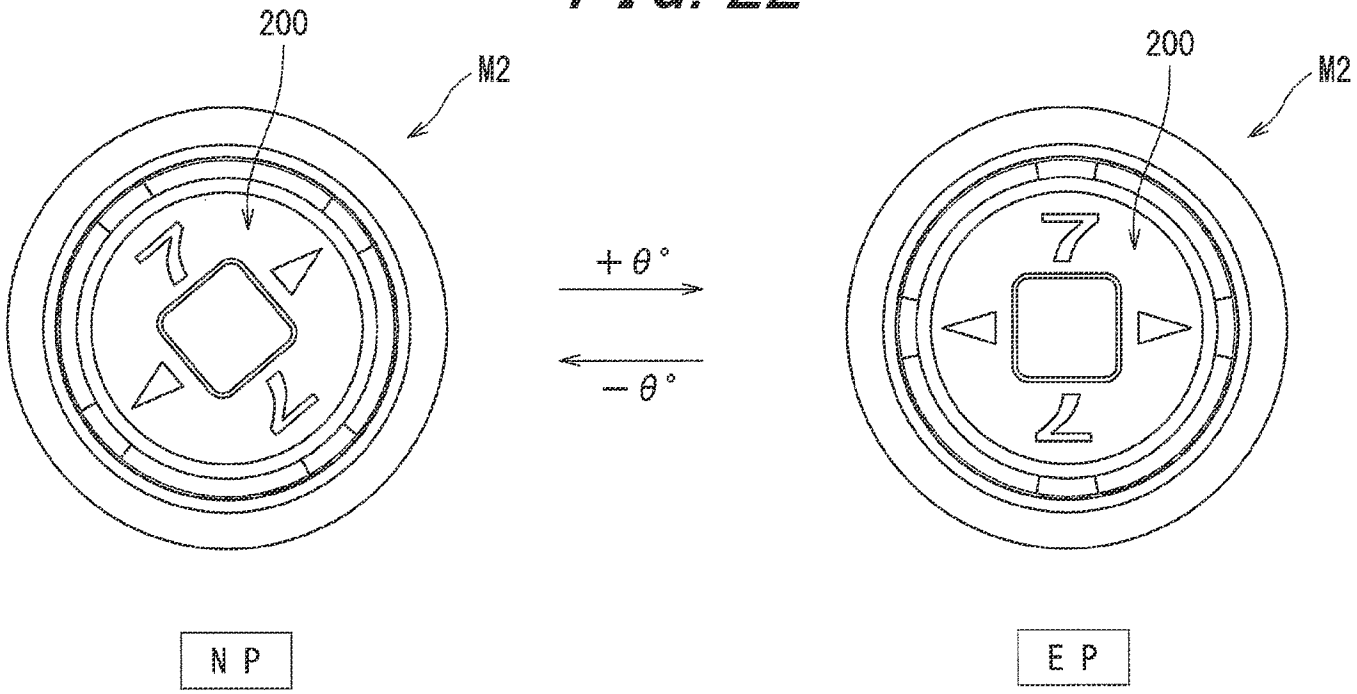
FIG. 22 is a plan view of a weight body attaching/detaching mechanism according to the second embodiment, and shows the non-engaging position NP and the engaging position EP.

FIG. 22 is a plan view of a weight body attaching/detaching mechanism M2. The weight body attaching/detaching mechanism M2 according to the second embodiment includes the weight body 200 and the socket 210. As in the above described weight body attaching/detaching mechanism M1, the socket 210 is housed in the socket housing part 14 of the head body h1, which is not shown.

The left side in FIG. 22 shows the non-engaging position NP, and the right side in FIG. 22 shows the engaging position EP. As in the above described weight body attaching/detaching mechanism M1, also in the weight body attaching/detaching mechanism M2, the mutual transition between the non-engaging position NP and the engaging position EP can be performed by the relative rotation of the angle θ.

In the mutual transition, the protrusion t1 slides on the recess part r1. The protrusion t1 abuts on the first stopper surface st1 in the non-engaging position NP, which is not shown. The protrusion t1 abuts on the second stopper surface st2 in the engaging position EP, which is not shown. Incorrect rotations other than the relative rotation are regulated by an engagement of the protrusion t1 and the recess part r1. Therefore, the excess rotation and the reverse rotation can be prevented. Typical examples of the incorrect rotations are the excess rotation and the reverse rotation.

Figure 23A:
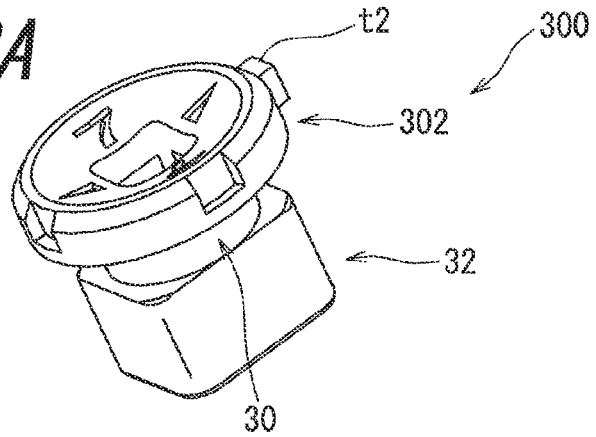
FIG. 23A is a perspective view of a weight body according to a third embodiment.
Figure 23B:
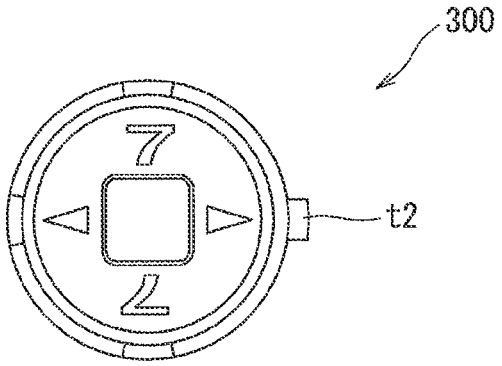
FIG. 23B is a plan view of the weight body.
Figure 23C:
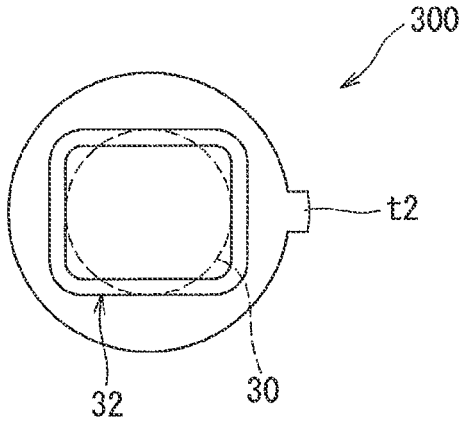
FIG. 23C is a bottom view of the weight body.

FIG. 23A is a perspective view of a weight body 300 according to the third embodiment. FIG. 23B is a plan view of the weight body 300. FIG. 23C is a bottom view of the weight body 300.

The weight body 300 includes a head part 302, a neck part 30 and an engaging part 32. The head part 302 includes a protrusion t2. The protrusion t2 is provided on a peripheral surface of the head part 202. The protrusion t2 protrudes in the axial perpendicular direction. The protrusion t2 is provided on one place in the circumferential direction. The protrusion t2 may be provided on a plurality of places in the circumferential direction.

The difference between the head part 302 and the above described head part 28 is only the existence or non-existence of the protrusion t2. The difference between the weight body 300 and the above described weight body 12 is only the existence or non-existence of the protrusion t2.

The protrusion t2 is an example of the first rotation regulating part.

Figure 24A:
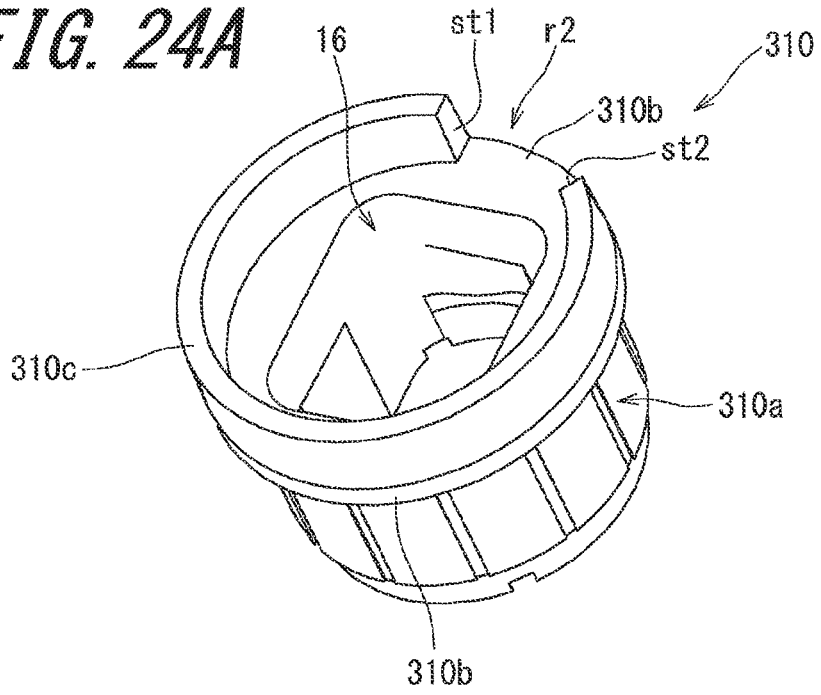
FIG. 24A is a perspective view of a socket according to the third embodiment.
Figure 24B:
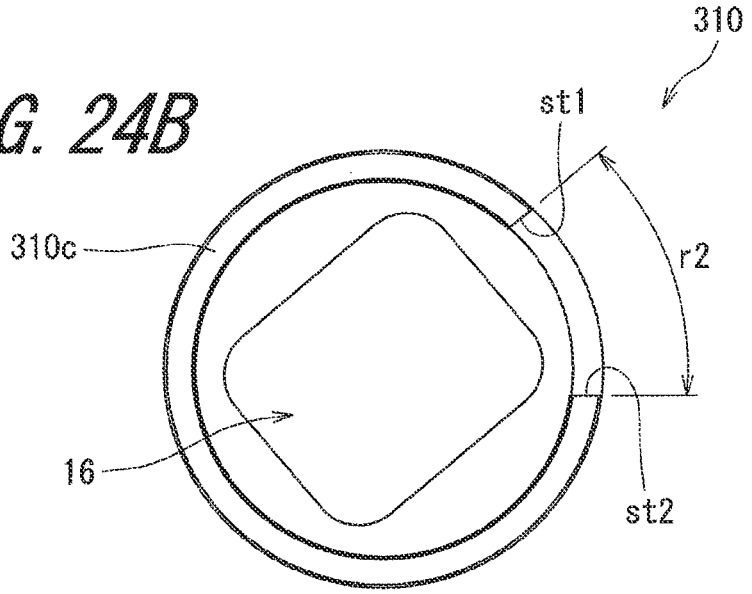
FIG. 24B is a plan view of the socket.

FIG. 24A is a perspective view of a socket 310 according to the third embodiment. FIG. 24B is a plan view of the socket 310. The socket 310 includes a body part 310*a*, a flange 310*b* and a wall part 310*c*. The body part 310*a* includes a hole 16. The flange 310*b* is provided on an upper end part of a peripheral surface of the body part 310*a*. The upper surface of the flange 310*b* and the upper surface of the body part 310*a* is the same plane surface. The wall part 310*c* is provided on the upper surface of the flange 310*b*. The wall part 310*c* protrudes toward an upper side.

The wall part 310*c* is provided along the circumferential direction. The wall part 310*c* includes a lack part r2. A part, in the circumferential direction, of the wall part 310*c* is lacked, and thereby the lack part r2 is formed. Because of the lack part r2, the first stopper surface st1 and the second stopper surface st2 are formed on the wall part 310*c*.

The lack part r2 is provided on one place in the circumferential direction. The lack part r2 may be provided on a plurality of places in the circumferential direction.

The wall part 310*c* including the lack part r2 is an example of the second rotation regulating part.

Figure 25:
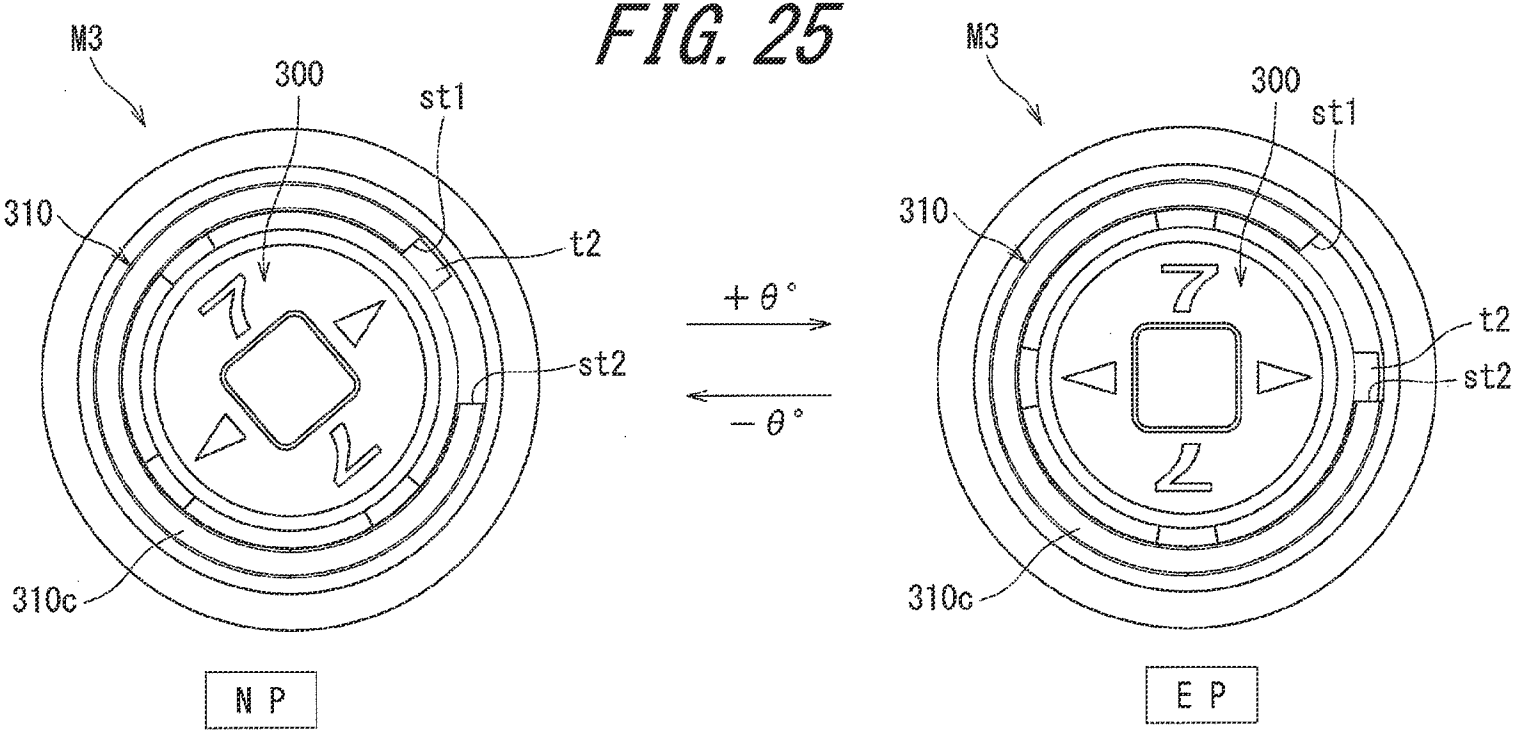
FIG. 25 is a plan view of a weight body attaching/detaching mechanism according to the third embodiment, and shows the non-engaging position NP and the engaging position EP.

FIG. 25 is a plan view of a weight body attaching/detaching mechanism M3. The weight body attaching/detaching mechanism M3 according to the third embodiment includes the weight body 300 and the socket 310. As in the above described weight body attaching/detaching mechanism M1, the socket 310 is housed in the socket housing part 14 of the head body h1, which is not shown.

The left side in FIG. 25 shows the non-engaging position NP, and the right side in FIG. 25 shows the engaging position EP. As in the above described weight body attaching/detaching mechanism M1, also in the weight body attaching/detaching mechanism M3, the mutual transition between the non-engaging position NP and the engaging position EP can be performed by the relative rotation of the angle θ.

In the mutual transition, the protrusion t2 moves in the lack part r2. The protrusion t2 moves between the first stopper surface st1 and the second stopper surface st2 along the circumferential direction. As shown in FIG. 25, the protrusion t2 abuts on the first stopper surface st1 in the non-engaging position NP. As shown in FIG. 25, the protrusion t2 abuts on the second stopper surface st2 in the engaging position EP. Incorrect rotations other than the relative rotation are regulated by an engagement of the protrusion t2 and the wall part 310*c*. Therefore, the excess rotation and the reverse rotation can be prevented.

Figure 26A:
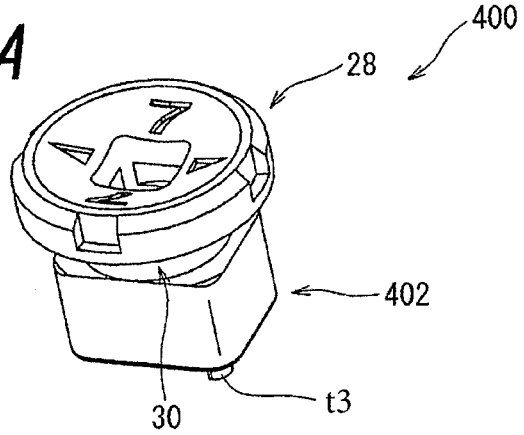
FIG. 26A is a perspective view of a weight body according to a fourth embodiment.
Figure 26B:
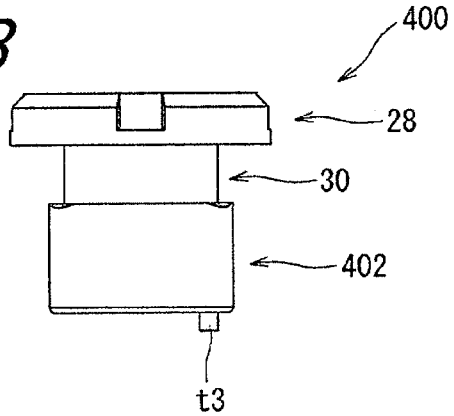
FIG. 26B is a side view of the weight body.
Figure 26C:
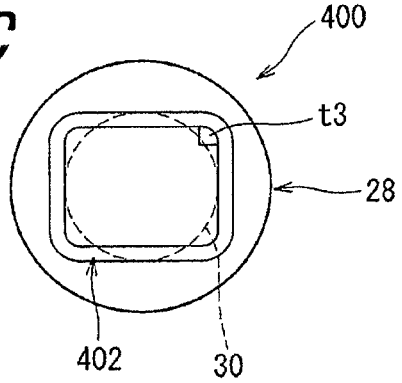
FIG. 26C is a bottom view of the weight body.

FIG. 26A is a perspective view of a weight body 400 according to a fourth embodiment. FIG. 26B is a side view of the weight body 400. FIG. 26C is a bottom view of the weight body 400.

The weight body 400 includes a head part 28, a neck part 30 and an engaging part 402. The engaging part 402 includes a protrusion t3. The protrusion t3 is provided on a bottom surface of the engaging part 402. The protrusion t3 is provided in the vicinity of a corner part of the engaging part 402. The protrusion t3 protrudes in the axial direction. The protrusion t3 protrudes toward a lower side. The protrusion t3 is provided on one place. The protrusion t3 may be provided on a plurality of places.

The difference between the engaging part 402 and the above described engaging part 32 is only the existence or non-existence of the protrusion t3. The difference between the weight body 400 and the above described weight body 12 is only the existence or non-existence of the protrusion t3.

The protrusion t3 is an example of the first rotation regulating part.

Figure 27A:
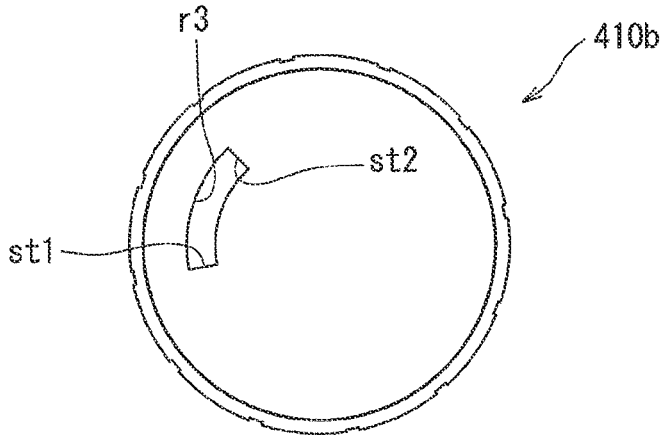
FIG. 27A is a plan view of a bottom face forming part of a socket according to the fourth embodiment.
Figure 27B:
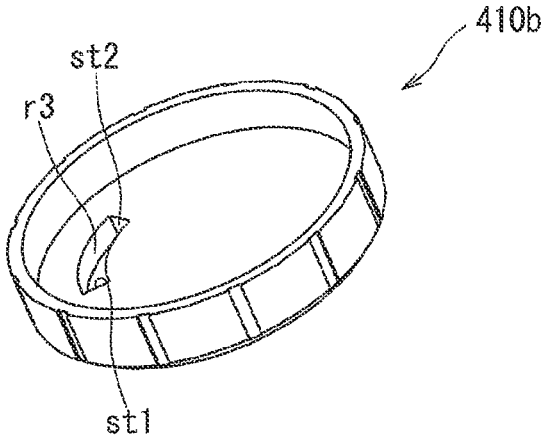
FIG. 27B is a perspective view of the bottom face forming part.

FIG. 27A is a plan view of a bottom face forming part 410*b* according to the fourth embodiment. FIG. 27B is a perspective view of the bottom face forming part 410*b*. The bottom face forming part 410*b* is attached to the above described body part 10*a*. The bottom face forming part 410*b* includes a long hole r3. A longitudinal direction of the long hole r3 runs along the circumferential direction.

In association with forming the long hole r3, the first stopper surface st1 and the second stopper surface st2 are formed in the bottom face forming part 410*b*. The first stopper surface st1 is formed on an end of the long hole r3. The second stopper surface st2 is formed on the other end of the long hole r3. The long hole r3 is provided on one place. The long hole r3 may be provided on a plurality of places.

The long hole r3 is an example of the second rotation regulating part.

Figure 28:
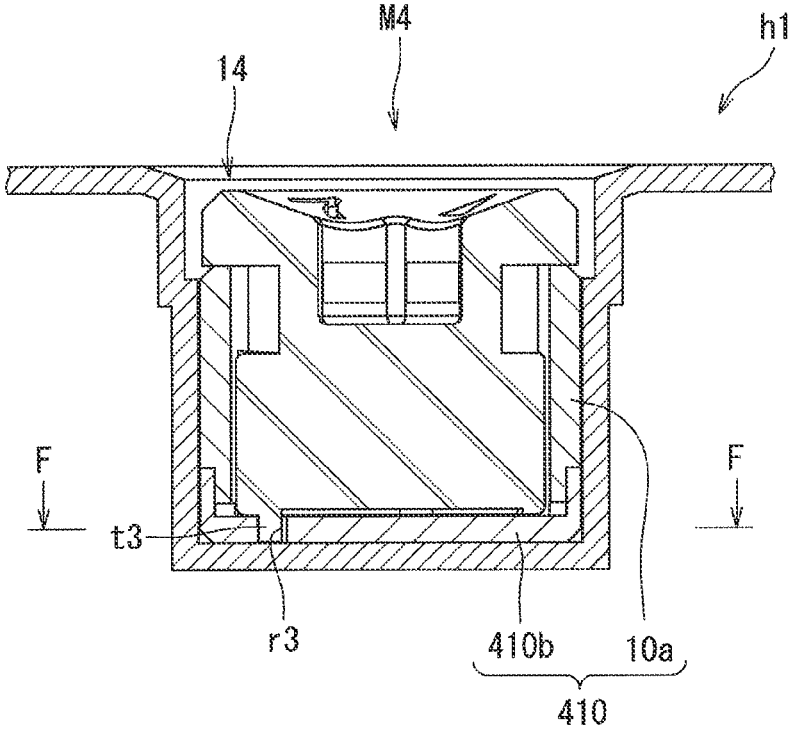
FIG. 28 is a cross-sectional view of a weight body attaching/detaching mechanism according to the fourth embodiment.

FIG. 28 is a cross-sectional view of a weight body attaching/detaching mechanism M4 according to the fourth embodiment. The weight body attaching/detaching mechanism M4 includes the weight body 400 and the socket 410. The socket 410 includes the bottom face forming part 410*b* and the above described body part 10*a*. The difference between the socket 410 and the above described socket 10 is only the existence or non-existence of the long hole r3.

As in the above described weight body attaching/detaching mechanism M1, the socket 410 is housed in the socket housing part 14 of the head body h1.

As shown in FIG. 28, the protrusion t3 extends to an inside of the long hole r3. In association with the relative rotation, the protrusion t3 moves in the long hole r3.

Figure 29:
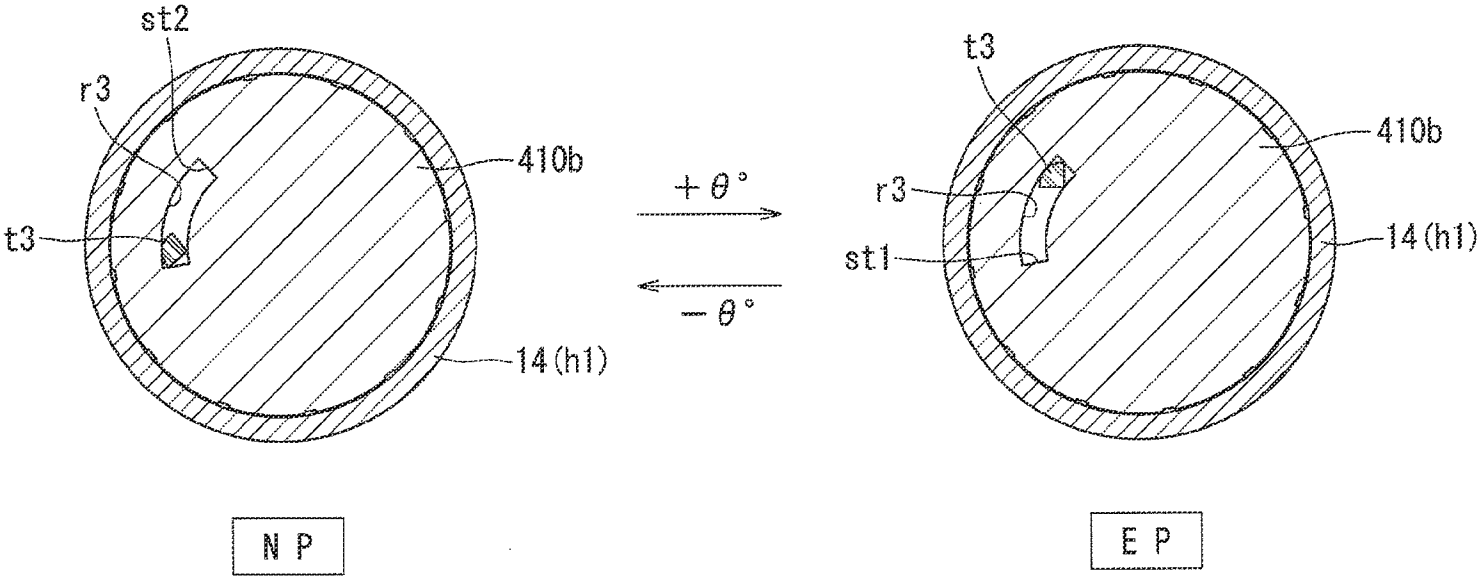
FIG. 29 is a cross-sectional view taken along line F-F of FIG. 28, and shows the non-engaging position NP and the engaging position EP.

FIG. 29 shows a cross-sectional view taken along line F-F of FIG. 28. The left side of FIG. 29 shows the non-engaging position NP, and the right side of FIG. 29 shows the engaging position EP. As in the above described weight body attaching/detaching mechanism M1, also in the weight body attaching/detaching mechanism M4, the mutual transition of the non-engaging position NP and the engaging position EP can be performed by the relative rotation of the angle θ.

In the mutual transition, the protrusion t3 moves in the long hole r3. The protrusion t3 moves between the first stopper surface st1 and the second stopper surface st2 along the circumferential direction. As shown in FIG. 29, the protrusion t3 abuts on the first stopper surface st1 in the non-engaging position NP. As shown in FIG. 29, the protrusion t3 abuts on the second stopper surface in the engaging position EP.

Incorrect rotations other than the relative rotation are regulated by an engagement of the protrusion t3 and the long hole r3. Therefore, the excess rotation and the reverse rotation can be prevented.

As described above, in the second, the third and the fourth embodiments, the weight body includes a first rotation regulating part, and the socket includes a second rotation regulating part. Incorrect rotations other than the relative rotation are regulated by the engagement of the first rotation regulating part and the second rotation regulating part.

In the embodiments, the protrusions t1 to t3 are exemplified as examples of the first rotation regulating part. It is sufficient that the first rotation regulating part can regulate the rotation of the weight body by engaging with the second rotation regulating part. The first rotation regulating part may be a projection part, a recess part, a long hole, or the like. The protrusion is an example of the projection part. The first rotation regulating part may include the first stopper surface st1 and the second stopper surface st2.

In the embodiments, the recess part r1, the wall part 310*c* and a long hole r3 are exemplified as the second rotation regulating part. In the embodiments, the second rotation regulating part includes a first stopper surface st1 and the second stopper surface st2. It is sufficient that the second rotation regulating part can regulate the rotation of the weight body by engaging with the first rotation regulating part. For example, the second rotation regulating part may be a projection part, such as a protrusion.

In respects of strength and durability, the material of the socket housing part 14 is preferably a metal. In the embodiments, the socket housing part 14 is integrally formed with other portions of the head body h1. The socket housing part 14 may be separately formed from the other portions of the head body h1. In this case, preferably, the socket housing part 14 is fixed to the head body h1 by welding.

As described above, the socket is formed of a polymer. The socket is present between the socket housing part and the weight body. The socket prevents the weight body from contacting with the socket housing part. If the weight body contacts with the socket housing part, an unusual sound can be emitted. The presence of the socket formed of a polymer suppresses the emission of the unusual sound.

As described above, the elastic modulus Es of the socket is smaller than the elastic modulus Eh of the head body h1. The elastic modulus Es of the socket is smaller than an elastic modulus Ea of the socket housing part. The socket having a low elastic modulus can effectively relieve an impact applied to the weight body. Therefore, the emission of the unusual sound is still further suppressed. In the present application, the elastic modulus means Young's modulus.

As shown in FIG. 10B and the like, the sectional shape of the engaging part 32 is a substantially rectangle. The term "substantially" means that the modification of the corner part is allowed. Typical examples of the substantially rectangle include a rectangle in which its corners are rounded as in the embodiments. Other examples of the substantially rectangle include a rectangle in which its corners are chamfered.

The sectional shape of the engaging part 32 may have N-fold rotation symmetry with the axis line Z as a rotation axis. N is, for example, an integer of 1 or greater and 4 or less. In the substantially rectangle of the embodiment, N is 2. That is, the substantially rectangle has 2-fold rotation symmetry.

The N-fold rotation symmetry means that a shape after being rotated by (360/N) degrees about the rotation axis coincides with a shape before being rotated. N is a positive integer. In other words, N is an integer of equal to or greater than 1. Preferably, N is an integer of 1 or greater and 4 or less. In the general definition of rotation symmetric property, N is an integer of equal to or greater than 2. However, in the present application, N includes 1. In the general definition, the shape has no rotation symmetric property when N is 1. However, in the present application, N may be 1. That is, in the present application, the sectional shape of the engaging part 32 may be "1-fold rotation symmetry".

In Japanese Utility Model Application Publication No. 3142270 described above, the sectional shape of the engaging part is a substantially square. In Japanese Utility Model Application Publication No. 3142270, N is 4. When the sectional shape of the engaging part is a substantially square, the hole 16 of the socket 10 and the engaging part 32 are relatively easily designed. In addition, when N is 4, the circumferential positions of the weight body 12 which can conform with the upper hole part 18 can also be 4. When the weight body 12 is inserted into the hole 16, it is necessary to conform the engaging part 32 with the upper hole part 18. For this conformation, the rotation of the weight body 12 can be needed. By setting N to be 4, the amount of the rotation of the weight body 12 for the conformation can be suppressed. By the suppression of the amount of the rotation, the weight body 12 can be easily inserted into the hole 16. The substantially square is a preferable example as the sectional shape of the engaging part.

Meanwhile, as shown in FIGS. 5 to 7 in Japanese Utility Model Registration Publication No. 3142270, in the case where the sectional shape of the engaging part is a substantially square, the reverse rotation suppressing part Rx and the excess rotation suppressing part Ry are apt to be decreased in size as compared with the case where N is equal to or less than 3. Therefore, the reverse rotation and the excess rotation described above are apt to occur. In the case where N is equal to or less than 3, the reverse rotation suppressing part Rx and the excess rotation suppressing part Ry are apt to be increased in size. Therefore, the reverse rotation and the excessive rotation described above are effectively suppressed. In light of suppressing the reverse rotation and the excessive rotation, N is preferably equal to or greater than 1 and equal to or less than 3.

When N is set to be equal to or less than 3, an angle of rotation required for the reverse rotation and the excess rotation can be increased. In addition, the reverse rotation suppressing part Rx and the excess rotation suppressing part Ry can be increased in size. Therefore, the reverse rotation and the excess rotation can be effectively decreased. For this reason, the reverse rotation suppressing part Rx and the excess rotation suppressing part Ry are less likely to be damaged. As a result, the socket 10 is less likely to be deteriorated through repeated use.

Examples in the case where N is 4 include a substantially square. Examples in the case where N is 3 include a substantially regular triangle. Examples in the case where N is 2 include a substantially parallelogram in addition to the substantially rectangle shown in the embodiment. When N is set to be equal to or less than 3, N is preferably 2. In this case, the sectional shape of the engaging part 32 is relatively simplified as compared with the case where N is 1. Therefore, the engaging part 32 and the socket 10 are easily designed.

As described above, in the present application, a radius R1 is defined. The longest rotation radius of the engaging part 32 is R1. The radius R1 is a rotation radius of the outermost part E1 . In the present application, the shortest rotation radius of the engaging part 32 is defined as R2. As shown in FIG. 18, the radius R1 is a distance between the rotation axis line Z and the point Pf. The radius R2 is a distance between the rotation axis line Z and a point Pc. The point Pc is a point nearest to the axis line Z in the outline of the section of the engaging part 32 (see FIG. 18).

In respect of increasing the reverse rotation suppressing part Rx and the excess rotation suppressing part Ry in size, R1/R2 is preferably equal to or greater than 1.30, more preferably equal to or greater than 1.33, and still more preferably equal to or greater than 1.36. In respect of decreasing the socket housing part 14 and the socket 10 in size, R1/R2 is preferably equal to or less than 1.70, more preferably equal to or less than 1.60, and still more preferably equal to or less than 1.50. In the embodiment, R1/R2 is 1.39.

A cross-sectional area X of the reverse rotation suppressing part Rx is shown by crosshatching in the cross-sectional view of the non-engaging position NP of FIG. 18. In respect of suppressing the reverse rotation, the cross-sectional area X is preferably equal to or greater than 1.5 $mm^2$, more preferably equal to or greater than 2.0 $mm^2$, and still more preferably equal to or greater than 2.5 $mm^2$. In respect of decreasing the socket housing part 14 and the socket 10 in size, the cross-sectional area X is preferably equal to or less than 5.0 $mm^2$, more preferably equal to or less than 4.5 $mm^2$, and still more preferably equal to or less than 4.0 $mm^2$. The cross-sectional area X is the cross-sectional area of one reverse rotation suppressing part Rx.

A cross-sectional area Y of the excess rotation suppressing part Ry is shown by crosshatching in the cross-sectional view of the engaging position EP of FIG. 18. In respect of suppressing the excess rotation, the cross-sectional area Y is preferably equal to or greater than 1.5 $mm^2$, more preferably equal to or greater than 2.0 $mm^2$, and still more preferably equal to or greater than 2.5 $mm^2$. In respect of decreasing the socket housing part 14 and the socket 10 in size, the cross-sectional area Y is preferably equal to or less than 5.0 $mm^2$, more preferably equal to or less than 4.5 $mm^2$, and still more preferably equal to or less than 4.0 $mm^2$. The cross-sectional area Y is the cross-sectional area of one excess rotation suppressing part Ry.

The maximum height of the reverse rotation suppressing part Rx is shown by a double pointed arrow R3 in FIG. 18. The height R3 is measured along the axial perpendicular direction. In respect of suppressing the reverse rotation, R3/R1 is preferably equal to or greater than 0.19, more preferably equal to or greater than 0.20, and still more preferably equal to or greater than 0.21. In respects of the size decrease and weight saving of the socket housing part 14 and the socket 10, R3/R1 is preferably equal to or less than 0.24, more preferably equal to or less than 0.23, and still more preferably equal to or less than 0.22.

The maximum height of the excess rotation suppressing part Ry is shown by a double pointed arrow R4 in FIG. 18. The height R4 is measured along the axial perpendicular direction. In respect of suppressing the excess rotation, R4/R1 is preferably equal to or greater than 0.19, more preferably equal to or greater than 0.20, and still more preferably equal to or greater than 0.21. In respects of the size decrease and weight saving of the socket housing part 14 and the socket 10, R4/R1 is preferably equal to or less than 0.24, more preferably equal to or less than 0.23, and still more preferably equal to or less than 0.22.

[Hardness Hs of Socket]

In respect of certainly securing the weight body 12 to suppress unusual sound in hitting, the hardness Hs of the socket is preferably equal to or greater than D40, more preferably equal to or greater than D42, and still more preferably equal to or greater than D45. In respect of wear resistance, the hardness Hs is preferably equal to or less than D80, more preferably equal to or less than D78, and still more preferably equal to or less than D76.

The hardness Hs is measured in accordance with regulation of "ASTM-D 2240-68" by using a Shore D type hardness scale attached to an automated rubber hardness measuring device ("P1" (trade name) manufactured by Koubunshi Keiki Co., Ltd.) The shape of a measurement sample is set to a cube having a side length of 3 mm. Measurement is performed under a temperature of 23° C. When possible, the measurement sample is cut out from the socket 10. When it is difficult to cut out the measurement sample, a measurement sample made of the same resin composition as that of the socket is used.

[Material of Socket]

In respect of a hardness, the material of the socket is preferably a polymer. Examples of the polymer include a thermosetting polymer and a thermoplastic polymer. Examples of the thermosetting polymer include a phenol resin, an epoxy resin, a melamine resin, a urea resin, an unsaturated polyester resin, an alkyd resin, a thermosetting polyurethane, a thermosetting polyimide, and a thermosetting elastomer. Examples of the thermoplastic polymer include polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, a thermoplastic polyimide, polyamide imide, and a thermoplastic elastomer.

Examples of the thermoplastic elastomer include a thermoplastic polyamide elastomer, a thermoplastic polyester elastomer, a thermoplastic polystyrene elastomer, a thermoplastic polyester elastomer, and a thermoplastic polyurethane elastomer.

In respect of durability, a urethane-based polymer and polyamide are preferable, and the urethane-based polymer is more preferable. Examples of the urethane-based polymer include polyurethane and a thermoplastic polyurethane elastomer. The urethane-based polymer may be thermoplastic, or may be thermosetting. In respect of formability, a thermoplastic urethane-based polymer is preferable, and the thermoplastic polyurethane elastomer is more preferable.

In respect of formability, the thermoplastic polymer is preferable. In respect of a hardness and durability, in the thermoplastic polymer, the polyamide and the thermoplastic polyurethane elastomer are preferable, and the thermoplastic polyurethane elastomer is more preferable.

Examples of the polyamide include nylon 6, nylon 11, nylon 12, and nylon 66.

A preferable thermoplastic polyurethane elastomer contains a polyurethane component as a hard segment, and a polyester component or a polyether component as a soft segment. That is, preferable examples of the thermoplastic polyurethane elastomer (TPU) include a polyester-based TPU and a polyether-based TPU. Examples of a curing agent for the polyurethane component include cycloaliphatic diisocyanate, aromatic diisocyanate, and aliphatic diisocyanate.

Examples of the cycloaliphatic diisocyanate include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI).

Examples of the aromatic diisocyanate include diphenylmethane diisocyanate (MDI) and toluene diisocyanate (TDI). Examples of the aliphatic diisocyanate include hexamethylene diisocyanate (HDI).

Commercially available examples of the thermoplastic polyurethane elastomer (TPU) include "Elastollan" (trade name) manufactured by BASF Japan Ltd.

Specific examples of the polyester-based TPU include "Elastollan C70A", "Elastollan C80A", "Elastollan C85A", "Elastollan C90A", "Elastollan C95A", and "Elastollan C64D".

Specific examples of the polyether-based TPU include "Elastollan 1164D", "Elastollan 1198A", "Elastollan 1180A", "Elastollan 1188A", "Elastollan 1190A", "Elastollan 1195A", "Elastollan 1174D", "Elastollan 1154D", and "Elastollan ET385".

In respects of versatility and productivity, an example of a preferable material of the socket is a resin. A fiber reinforced resin containing each of the polymers as a matrix may be used.

EXAMPLES

Hereinafter, the effects of the present invention will be clarified by examples. However, the present invention should not be interpreted in a limited way based on the description of examples.

Example 1

A head having the same structure as that of the head 4 was produced as follows.

A face member was obtained by pressing a rolled material made of a titanium alloy (Ti-6Al-4V). A body was obtained by casting using a titanium alloy (Ti-6Al-4V). The body included a socket housing part. A head body was obtained by welding the obtained face member and body.

A socket was obtained by injection molding. A thermoplastic polyurethane elastomer was used as the material of the socket. Specifically, a product material obtained by mixing "Elastollan 1164D" with "Elastollan 1198A" at a weight ratio of 1:1 was used.

A tungsten nickel alloy (W—Ni alloy) was used as the material of a weight body. The W—Ni alloy was molded by powder sintering, to obtain the weight body. The mass of the weight body was 11 g.

The socket was inserted into a socket housing part. The socket was inserted from the outer side of the head. The socket was bonded to the socket housing part using an adhesive agent. "DP460" (trade name) manufactured by Sumitomo 3M Ltd. was used as the adhesive agent.

The weight body was attached to the socket by using the tool 60 described above, to obtain a head of example 1. A grip and the head of example 1 were attached to a shaft, to obtain a club according to example 1. The angle θ was 40°. The ratio (S1/S2) was 0.7.

Example 2

A club according to example 2 was obtained in the same manner as in example 1 except that the socket and the weight body were changed to those of the second embodiment (FIGS. 20 and 21).

Example 3

A club according to example 3 was obtained in the same manner as in example 1 except that the socket and the weight body were changed to those of the third embodiment (FIGS. 23 and 24).

Example 4

A club according to example 4 was obtained in the same manner as in example 1 except that the socket and the weight body were changed to those of the fourth embodiment (FIGS. 26 and 27).

[Durability Test]

The club was attached to a swing robot, and a commercially available two-piece ball was hit by the swing robot for 10,000 times. The head speed was 54 m/s. In any of the examples, the securement of the socket and the weight body was maintained during hitting the ball for 10,000 times.

In examples 1 to 4, by adjusting the ratio (S1/S2), the torque required for the relative rotation could be set easily with high accuracy. Furthermore, since the ratio (S1/S2) was set to be less than 1, the torque could be suppressed.

It was confirmed that, in examples 1 to 4, the rotation of the weight body is regulated to only the relative rotation of the angle θ (40°).

The invention described above can be applied to all golf clubs. The present invention can be used for a wood type club, a utility type club, a hybrid type club, an iron type club, and a putter club or the like.

The description hereinabove is merely for an illustrative example, and various modifications can be made in the scope not to depart from the principles of the present invention.

What is claimed is:

1. A golf club head comprising a head body, a socket and a weight body, wherein the head body includes a socket housing part, the socket is attached to the socket housing part, the socket includes an upper hole part and a lower hole part, a sectional shape of the upper hole part is different from a sectional shape of the lower hole part, the weight body includes an engaging part, the engaging part includes an outermost part which is farthest from a rotation axis line of the weight body, the engaging part is disposed inside the lower hole part, relative rotation can be performed between the lower hole part and the engaging part so that the weight body can take an engaging position and an non-engaging position by the relative rotation, the lower hole part includes a first portion and a second portion, the first portion and the second portion are provided on a passing region of the outermost part, the outermost part passes through the first portion while compressively deforming the first portion in a process of the relative rotation, and when a distance between the first portion and the rotation axis line is defined as D1, and a distance between the second portion and the rotation axis line is defined as D2, the distance D2 is greater than the distance D1 in a same circumferential position.

2. The golf club head according to claim 1, wherein the second portion includes a non-contact surface which does not contact with the outermost part in the process of the relative rotation.

3. The golf club head according to claim 1, wherein the second portion is positioned on a lower side of the first portion.

4. The golf club head according to claim 1, wherein the weight body includes a first rotation regulating part, the socket includes a second rotation regulating part, non-correct rotations other than the relative rotation are regulated by an engagement of the first rotation regulating part and the second rotation regulating part.

5. The golf club head according to claim 1, wherein when an axial-directional length of the first portion is defined as S1, and an axial-directional length of the outermost part is defined as S2, S1/S2 is equal to or greater than 0.3 and equal to or less than 0.9.

6. A golf club head comprising a head body, a socket and a weight body, wherein the head body includes a socket housing part, the socket is attached to the socket housing part, the socket includes an upper hole part and a lower hole part, a sectional shape of the upper hole part is different from a sectional shape of the lower hole part, the weight body includes an engaging part, the engaging part includes an outermost part which is farthest from a rotation axis line of the weight body, the engaging part is disposed inside the lower hole part, relative rotation can be performed between the lower hole part and the engaging part so that the weight body can take an engaging position and an non-engaging position by the relative rotation, the lower hole part includes a first portion and a second portion, the first portion includes a compressive deformation part which can be compressively deformed by the outermost part in a process of the relative rotation, the second portion is provided on an upper side or a lower side of the compressive deformation part, and when a distance between the first portion and the rotation axis line is defined as D1, and a distance between the second portion and the rotation axis line is defined as D2, the distance D2 is greater than the distance D1 in a same circumferential position.

7. The golf club head according to claim 6, wherein the second portion includes a non-contact surface which does not contact with the outermost part in the process of the relative rotation.

8. The golf club head according to claim 6, wherein the second portion is positioned on a lower side of the first portion.

9. The golf club head according to claim 6, wherein the weight body includes a first rotation regulating part, the socket includes a second rotation regulating part, non-correct rotations other than the relative rotation are regulated by an engagement of the first rotation regulating part and the second rotation regulating part.

10. The golf club head according to claim 6, wherein when an axial-directional length of the first portion is defined as S1, and an axial-directional length of the outermost part is defined as S2, S1/S2 is equal to or greater than 0.3 and equal to or less than 0.9.

* * * * *